US012110702B2

(12) United States Patent
Wasson et al.

(10) Patent No.: US 12,110,702 B2
(45) Date of Patent: Oct. 8, 2024

(54) TILT SYSTEM FOR TELESCOPING MAST

(71) Applicant: The Will-Burt Company, Orrville, OH (US)

(72) Inventors: Andrew Paul Wasson, Wooster, OH (US); Brian Scott Wetrich, Canton, OH (US); Wendel Mark Niles, Canton, OH (US)

(73) Assignee: The Will-Burt Company, Orrville, OH (US)

( * ) Notice: Subject to any disclaimer, the term of this patent is extended or adjusted under 35 U.S.C. 154(b) by 4 days.

(21) Appl. No.: 17/886,007

(22) Filed: Aug. 11, 2022

(65) Prior Publication Data

US 2023/0050712 A1 Feb. 16, 2023

Related U.S. Application Data

(60) Provisional application No. 63/233,023, filed on Aug. 13, 2021.

(51) Int. Cl.
*E04H 12/34* (2006.01)
*E04H 12/18* (2006.01)
*E04H 12/22* (2006.01)

(52) U.S. Cl.
CPC ..... *E04H 12/345* (2013.01); *E04H 12/182* (2013.01); *E04H 12/2284* (2013.01)

(58) Field of Classification Search
CPC .. E04H 12/345; E04H 12/182; E04H 12/2284
USPC ..... 52/116, 118
See application file for complete search history.

(56) References Cited

U.S. PATENT DOCUMENTS 608,193 A * 8/1898 Gordon ..... A01G 23/043 414/23
2,225,561 A * 12/1940 Henry ..... E21B 15/00 52/120
2,841,634 A * 7/1958 Kimball ..... E04H 12/182 174/45 R
3,009,546 A * 11/1961 Anderson, Sr. ..... E04H 12/187 187/242
4,267,675 A * 5/1981 Cochran ..... E21B 7/023 414/22.58
4,393,944 A * 7/1983 Gugger ..... E21B 15/04 173/28

(Continued)

FOREIGN PATENT DOCUMENTS

EP 1 079 046 A2 2/2001
EP 3 736 394 A1 11/2020

OTHER PUBLICATIONS

International Search Report and Written Opinion of International Application Serial No. PCST/US2022/040075 dated Nov. 23, 2022, 15 pages.

*Primary Examiner* — Brent W Herring
(74) *Attorney, Agent, or Firm* — Lippes Mathias LLP

(57) ABSTRACT

A tilting and telescoping mast assembly having a compact device footprint that can be mounted in close proximity to, for example, a front wall of a truck bed (e.g., adjacent the cab) thereby reducing dead space within the truck bed and maximizing cargo space within the bed. The mast of the present disclosure is configured to be supported by its base in a first position when in the horizontal orientation and supported in a second position when in the vertical orientation, with the first and second positions being spaced apart horizontally and/or vertically.

13 Claims, 25 Drawing Sheets

(56) References Cited

U.S. PATENT DOCUMENTS

| | | | | |
|---|---|---|---|---|
| 4,413,451 | A | 11/1983 | Featherstone et al. | |
| 4,447,997 | A * | 5/1984 | Delgado | E21B 15/00 52/127.2 |
| 4,600,980 | A * | 7/1986 | Dahlgren | F21V 21/22 362/385 |
| 6,299,336 | B1 * | 10/2001 | Hulse | B60Q 1/2657 362/198 |
| 9,309,686 | B2 * | 4/2016 | Gorney | E04H 12/345 |
| 2012/0114484 | A1 * | 5/2012 | Tosello | E02D 27/52 29/889 |
| 2014/0259986 | A1 | 9/2014 | Kwartler et al. | |
| 2015/0292227 | A1 | 10/2015 | Gorney et al. | |
| 2016/0261019 | A1 * | 9/2016 | Garmong | H01Q 1/3216 |
| 2017/0254106 | A1 * | 9/2017 | Bruinsma | F21V 21/22 |

* cited by examiner

TILT SYSTEM FOR TELESCOPING MAST

FIELD

The present exemplary embodiment relates to a tilting and telescoping mast assembly. It finds particular application in conjunction with a tilting and telescoping mast mechanism configured to be mounted in a truck bed or other vehicle cargo location and will be described with particular reference thereto. However, it is to be appreciated that the present exemplary embodiment is also amenable to other like applications.

BACKGROUND

Tilting and telescoping masts are known. For example, U.S. Pat. No. 4,413,451 discloses a typical tilting and telescoping mast. Prior art tilting masts generally include a base mountable to a vehicle, and a mast pivotally supported by the base for movement between a horizontal orientation and a vertical orientation about a pivot axis. Generally, the pivot axis of the mast is perpendicular to and intersects with a longitudinal axis of the mast (e.g., the mast is configured to tilt "on end"). Accordingly, a bottom end of the mast is pivotally secured to the base and fixed in the x, y, and z directions relative to the base.

Known tilting and telescoping masts are suitable for many installations where size constraints are not an issue. Such designs, however, do not minimize device footprint and therefore can be less than ideal in certain installations. For example, FIG. 1 illustrates a prior art tilting mast assembly 10 installed in a truck bed 12 in a horizontal orientation. The prior art tilting mast assembly 10 must be mounted in spaced relation to the front wall 14 of the bed (e.g., behind the cab) to accommodate the mast assembly 10 when it is in the vertical orientation. This results in dead space 16 which reduces the cargo area of the truck bed and reduces the height for payload on the mast.

BRIEF DESCRIPTION

Aspects of the present disclosure are directed to a tilting and telescoping mast assembly having a compact device footprint and low profile height that can be mounted in close proximity to, for example, a front wall of a truck bed (e.g., adjacent the cab) thereby reducing dead space within the truck bed and maximizing cargo space within the bed and mast payload height. The mast of the present disclosure is configured to be supported by its base in a first position when in the horizontal orientation and supported in a second position when in the vertical orientation, with the first and second positions being spaced apart horizontally and/or vertically. In one exemplary embodiment, the mast is supported for rotation about a fixed axis that is perpendicular to a longitudinal axis of the mast but spaced apart from the bottom end of the mast. In another exemplary embodiment, the mast is supported for pivoting movement on a carriage that translates and rotates relative to the base as the mast is rotated between the horizontal and vertical orientations. The mast assembly of the present disclosure can have an overall height when in the horizontal orientation of less than 21 inches such that the mast assembly does not protrude above the sides of a typical truck bed. A silent and non-contact detent mechanism is also disclosed.

In accordance with one aspect of the present disclosure, a tilting and telescoping mast assembly comprises a mast having a longitudinal axis, and a tilt mechanism supporting the mast for pivoting about a tilt rotation axis between a first position and a second position. The tilt rotation axis is perpendicular to and spaced from the longitudinal axis of the mast, whereby the mast is displaced in a horizontal direction as the tilt mechanism rotates the mast between the first and second positions.

The tilt mechanism can include a base mountable to a surface, first and second side walls extending from the base, and a tilt frame supported between the first and second side walls for movement between a horizontal orientation and a vertical orientation, wherein the mast is supported by the tilt frame. Bearings received in each side wall can support the tilt frame for pivoting. A locking mechanism for securing the tilt frame in at least one of the first position or the second position can be provided. The locking mechanism can include a lock wedge supported on a rod of the tilt frame and configured to engage a lock block supported on an outside of one of the side walls to restrict movement of the tilt frame relative to the side wall, the lock wedge being rotatable between a release position and an engaged position. At least one of the side walls can include an opening through which the rod extends, the rod configured to move within the opening as the tilt frame pivots between the first and second positions. An actuator can be operatively coupled to the lock wedge to rotate the lock wedge between the release position and the engaged position. A tilt actuator can be operatively coupled to the tilt frame rotate the tilt frame. The tilt actuator can include a leadscrew coupled to the tilt frame, the leadscrew operative to rotate the tilt frame from the horizontal orientation to the vertical orientation when turned in a first direction. The leadscrew can include a threaded shaft and a carriage threadedly engaged with the threaded shaft such that rotation of the leadscrew in a first direction advances the carriage along the shaft and rotation of the leadscrew in a second direction opposite the first direction retracts the carriage along the shaft, and wherein the carriage is coupled to the tilt frame by a cable. The assembly can include horizontal lock block, a vertical lock block and an intermediate lock block, wherein each of the lock blocks are mounted to a common sidewall adjacent the opening in the sidewall, and wherein the lock wedge is separately engageable with any one of the lock blocks when the lock block is in a first orientation to secure the tilt frame against rotation, and wherein the lock wedge, in a second orientation, passes freely by the intermediate lock block as the tilt frame moves between the horizontal and vertical orientations, whereby the lock wedge and the intermediate lock block function as a silent ratchet mechanism.

In accordance with another aspect of the present disclosure, a tilt mechanism for supporting an associated mast for pivoting between a first position and a second position about a tilt rotation axis comprises a tilt frame supported for rotation about the tilt rotation axis, wherein the tilt rotation axis is perpendicular to and spaced from a longitudinal axis of the associated mast. The associated mast is displaced in a horizontal direction as the tilt mechanism rotates the associated mast between the first and second positions.

The tilt mechanism can include a base mountable to a surface, and first and second side walls extending from the base, wherein the tilt frame is supported between the first and second side walls for movement between a horizontal orientation and a vertical orientation, and wherein the associated mast is supported by the tilt frame. Bearings received in each side wall can support the tilt frame for pivoting. A locking mechanism for securing the tilt frame in at least one of the first position or the second position can be provided. The locking mechanism can include a lock wedge supported on a rod of the tilt frame and configured to engage a lock block supported on an outside of one of the side walls to restrict movement of the tilt frame relative to the side wall, the lock wedge being rotatable between a release position and an engaged position. At least one of the side walls can include an opening through which the rod extends, the rod configured to move within the opening as the tilt frame pivots between the first and second positions. An actuator can be operatively coupled to the lock wedge to rotate the lock wedge between the release position and the engaged position. A tilt actuator can be operatively coupled to the tilt frame to rotate the tilt frame. The tilt actuator can include a leadscrew coupled to the tilt frame; the leadscrew operative to rotate the tilt frame from the horizontal orientation to the vertical orientation when turned in a first direction. The leadscrew can include a threaded shaft and a carriage threadedly engaged with the threaded shaft such that rotation of the leadscrew in a first direction advances the carriage along the shaft and rotation of the leadscrew in a second direction opposite the first direction retracts the carriage along the shaft, and wherein the carriage is coupled to the tilt frame by a cable.

In accordance with another aspect of the present disclosure, a method of deploying a tilting and telescoping mast assembly comprises supporting a mast assembly having a longitudinal axis with a tilt mechanism configured to pivot the mast assembly between a first position and a second position about a tilt rotation axis perpendicular to and spaced from the longitudinal axis of the telescoping mast, and pivoting the mast assembly using the tilt mechanism, whereby the mast assembly is displaced in a horizontal direction as the tilt mechanism rotates the mast assembly between the first and second positions.

DETAILED DESCRIPTION

Figure 1:
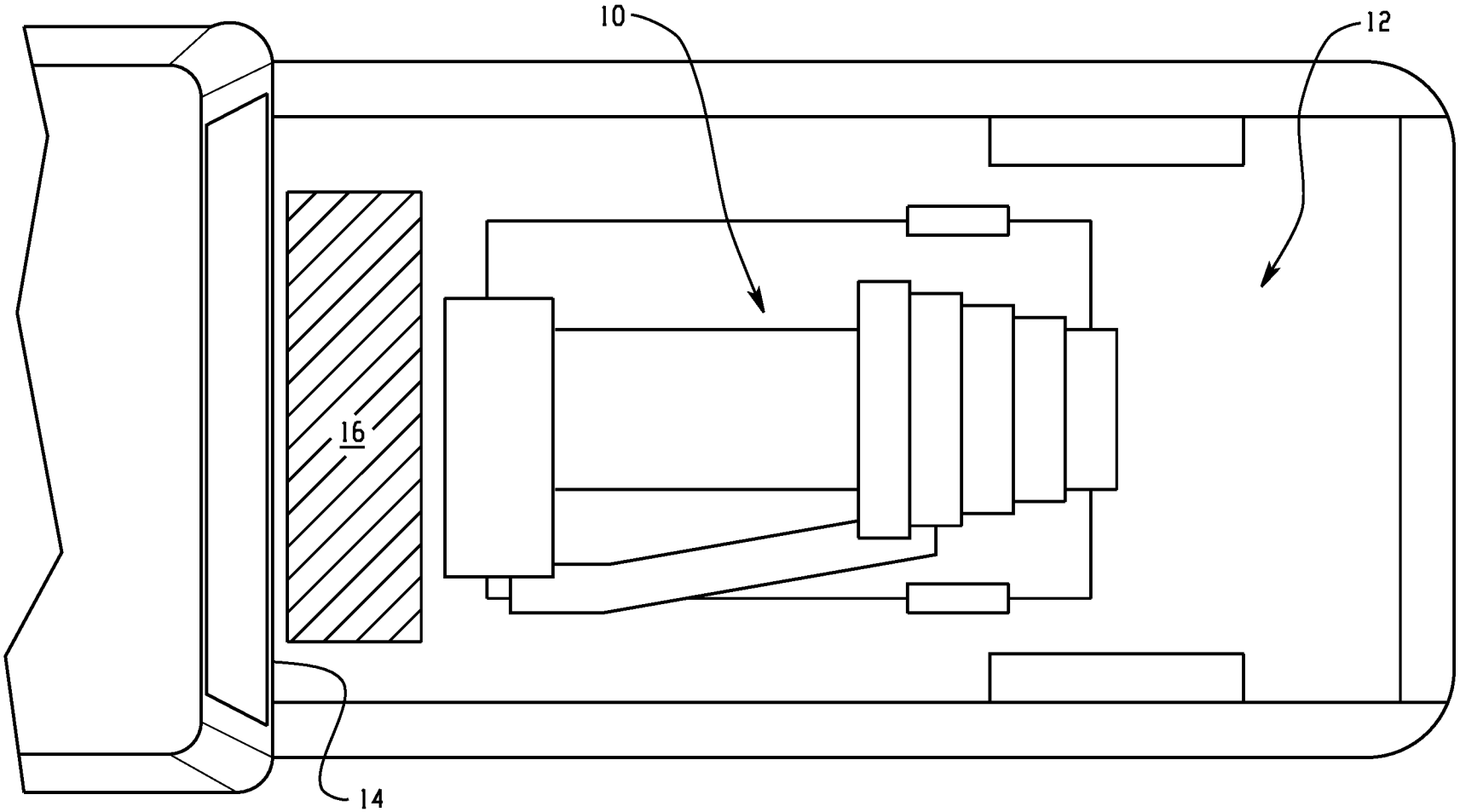
Fig. 1 PRIOR ART
FIG. 1 is a prior art tilting mast assembly installed in a truck bed.
Figure 2:
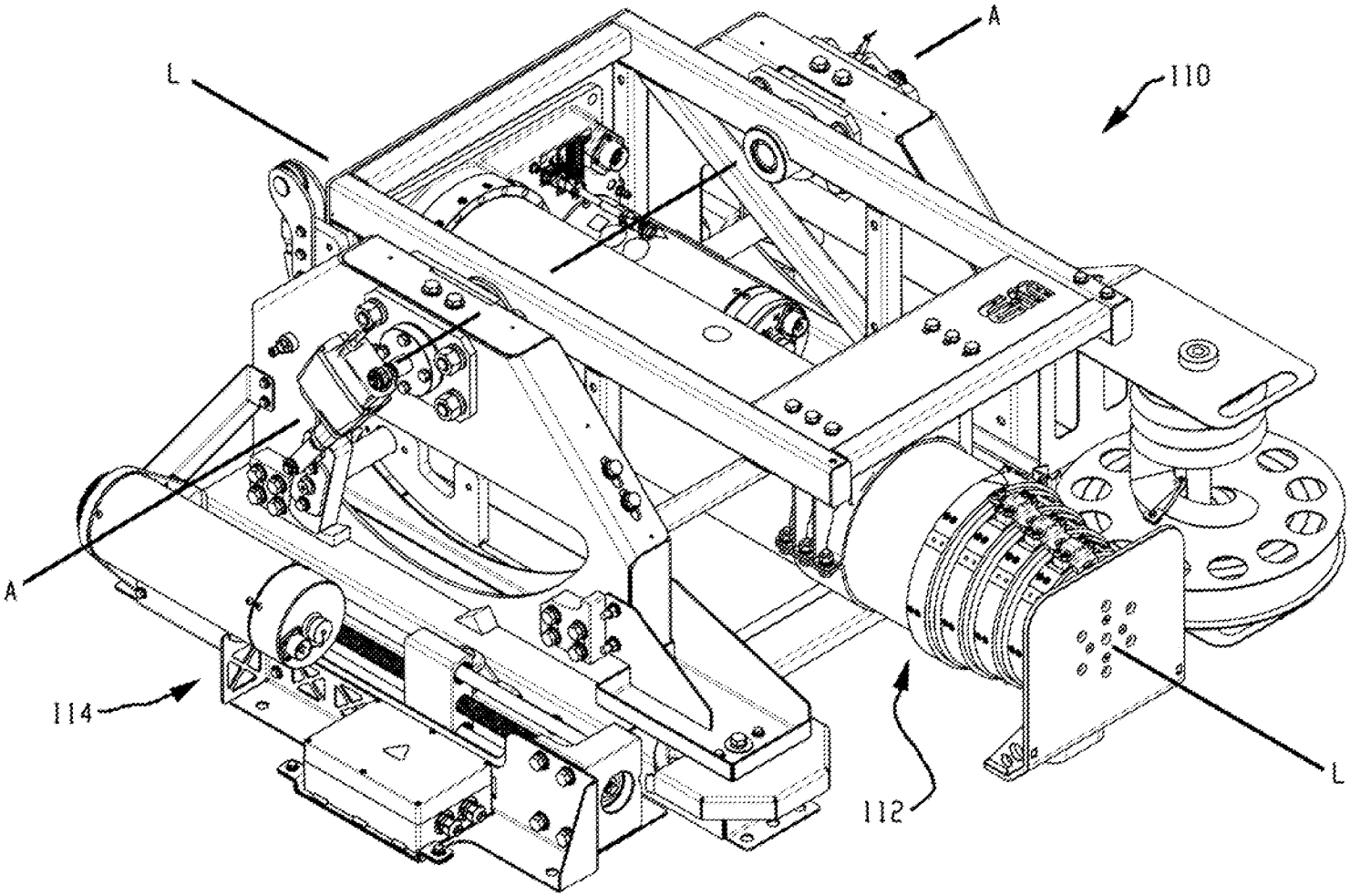
FIG. 2 is a front left perspective view of an exemplary tilting and telescoping mast assembly in a horizontal orientation in accordance with the present disclosure.
Figure 3:
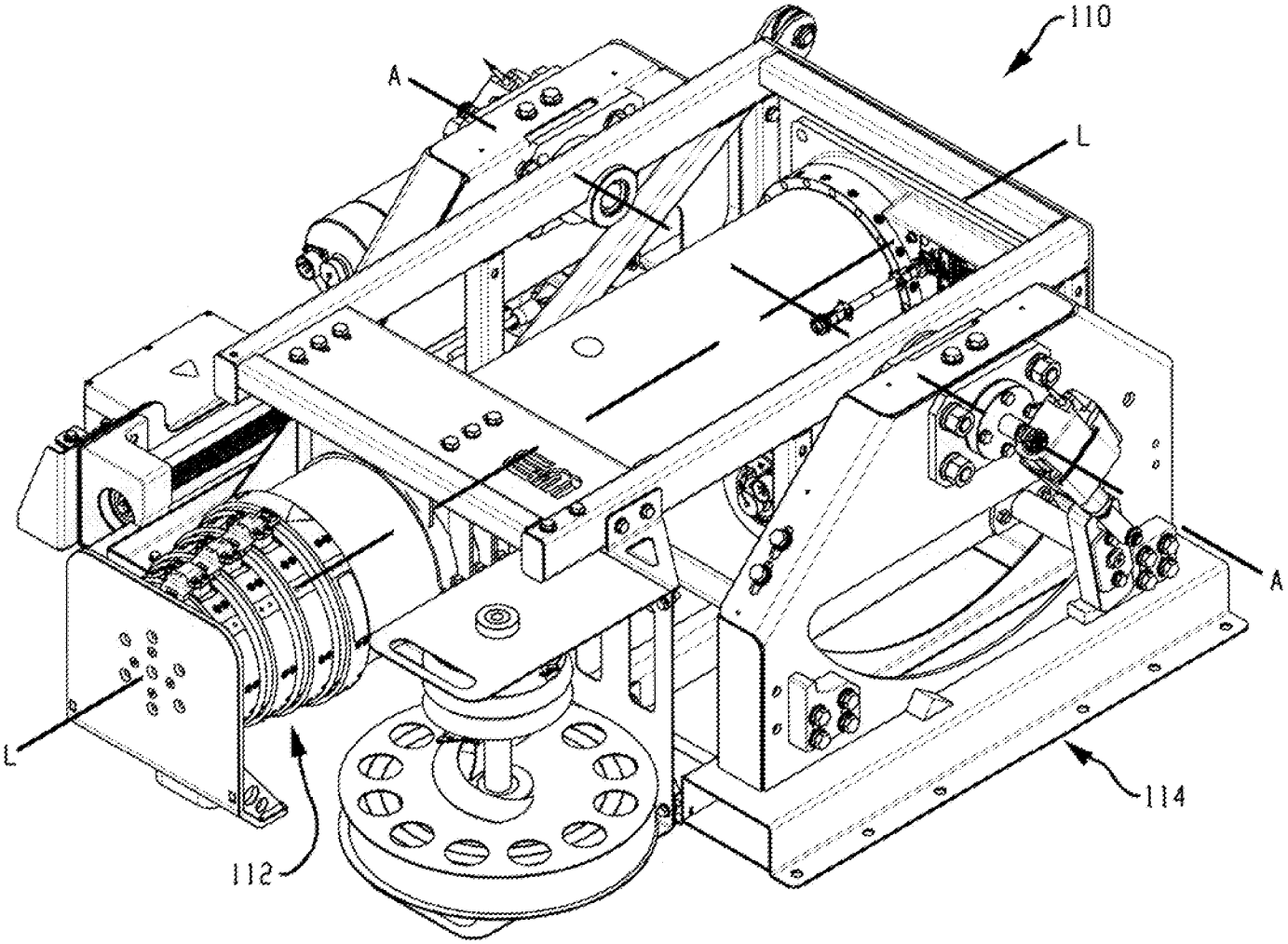
FIG. 3 is a front right perspective view of the mast assembly in a horizontal orientation.

With reference to FIGS. 2-17, and initially to FIGS. 2-5, an exemplary tilting and telescoping mast assembly is illustrated and identified generally by reference numeral 110. The mast assembly 110 includes a telescoping mast 112 having longitudinal axis L-L and being supported for movement between a horizontal orientation and a vertical orientation by a tilt assembly 114. The tilting and telescoping mast assembly 110 is illustrated in a horizontal orientation in FIGS. 2 and 3, and a vertical orientation in FIGS. 4 and 5. FIGS. 6-17 illustrate the tilting and telescoping mast assembly 110 with the telescoping mast 112 removed so that the features of the tilt assembly 114 are more readily visible. The telescoping mast 112 can be any suitable telescoping mast and, as such, the details of the telescoping mast 112 will not be described herein.

Figure 4:
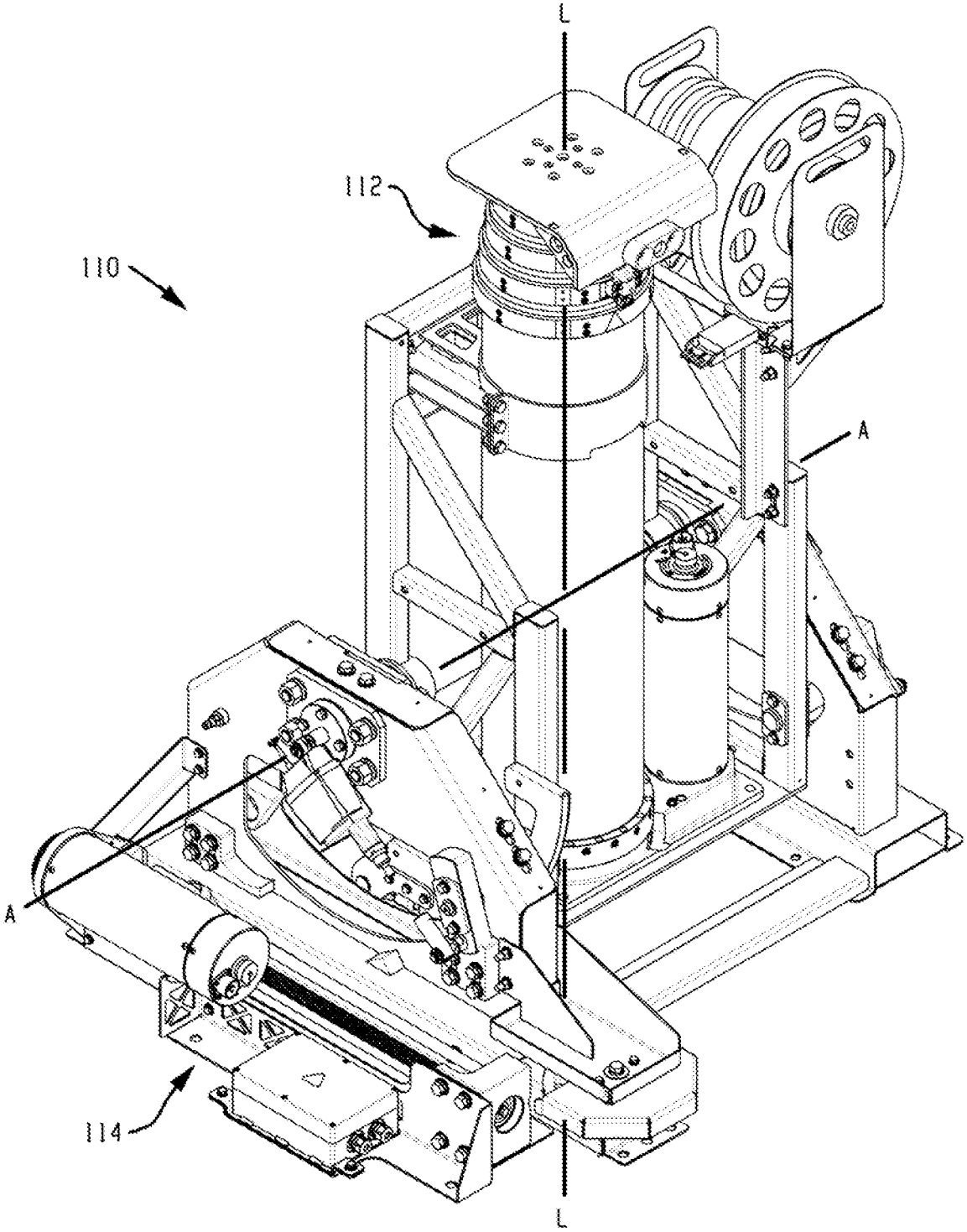
FIG. 4 is a front left perspective view of the mast assembly in a vertical orientation.
Figure 5:
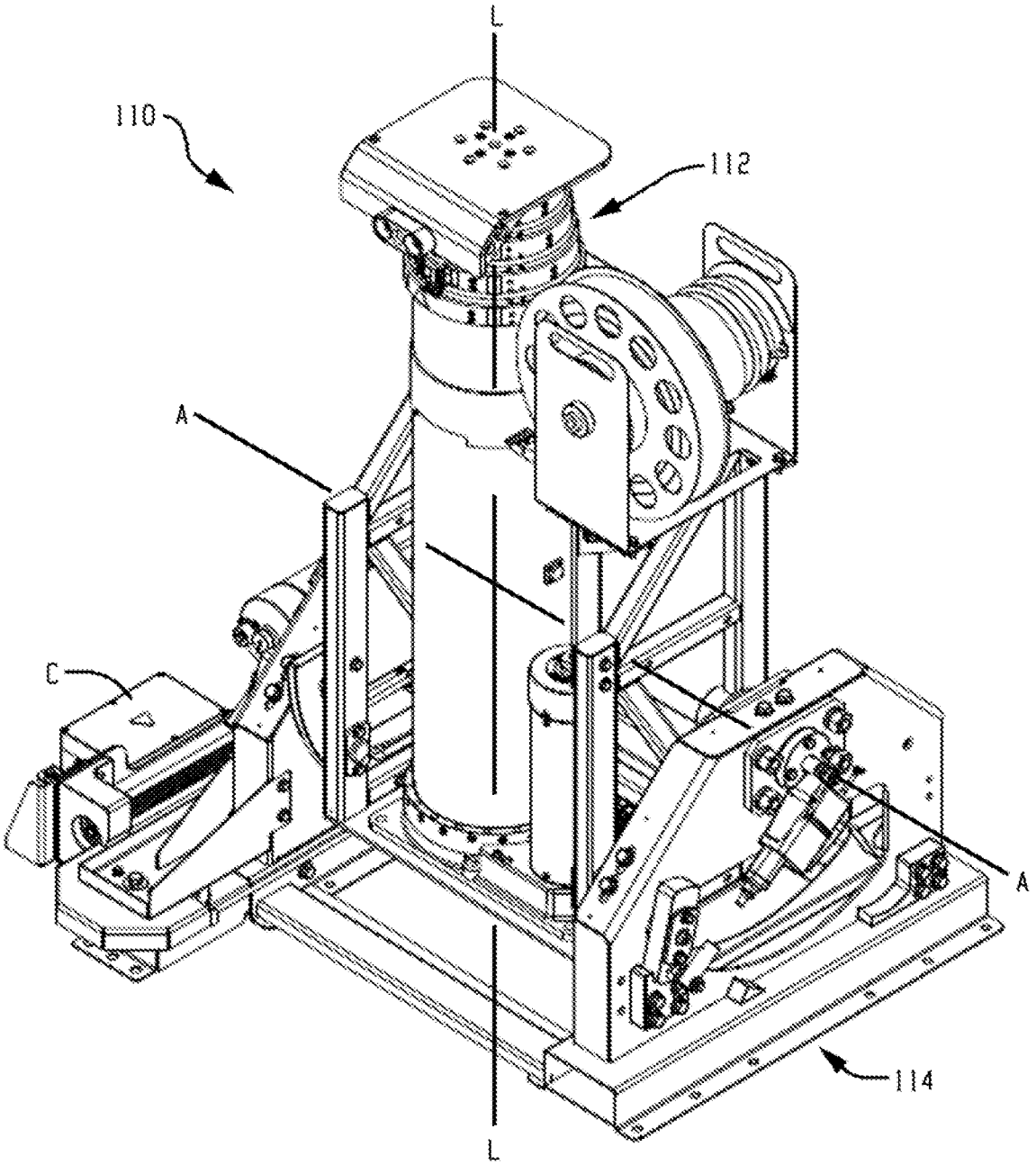
FIG. 5 is a front right perspective view of the mast assembly in a vertical orientation.
Figure 6:
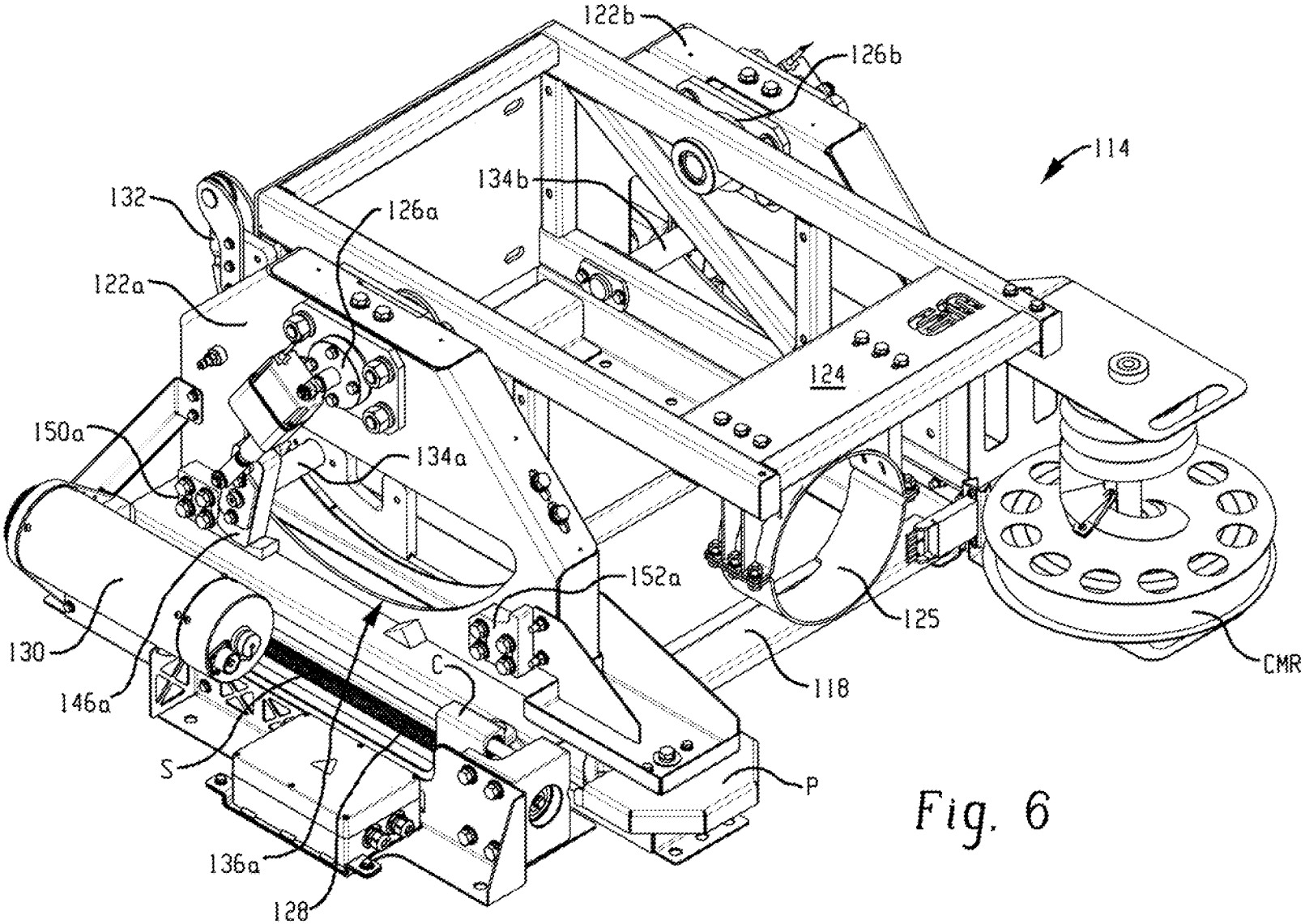
FIG. 6 is a front left perspective view of an exemplary tilt mechanism in a horizontal orientation.

Turning to FIGS. 6-17, the tilt assembly 114 generally includes a base 118 mountable to a surface, such as a truck bed, and a pair of spaced-apart side walls 122*a* and 122*b* extending upwardly from the base 118. A tilt frame 124 is mounted to the side walls 122*a* and 122*b* by bearings 126*a* and 126*b*. The tilt frame 124 includes a mast support ring 125 and supports the mast assembly 112 for pivoting movement about a tilt axis A-A between the horizontal orientation (FIGS. 2 and 3) and the vertical orientation (FIGS. 4 and 5). A cable manage reel CMR is provided for managing connections to the mast payload.

Figure 8:
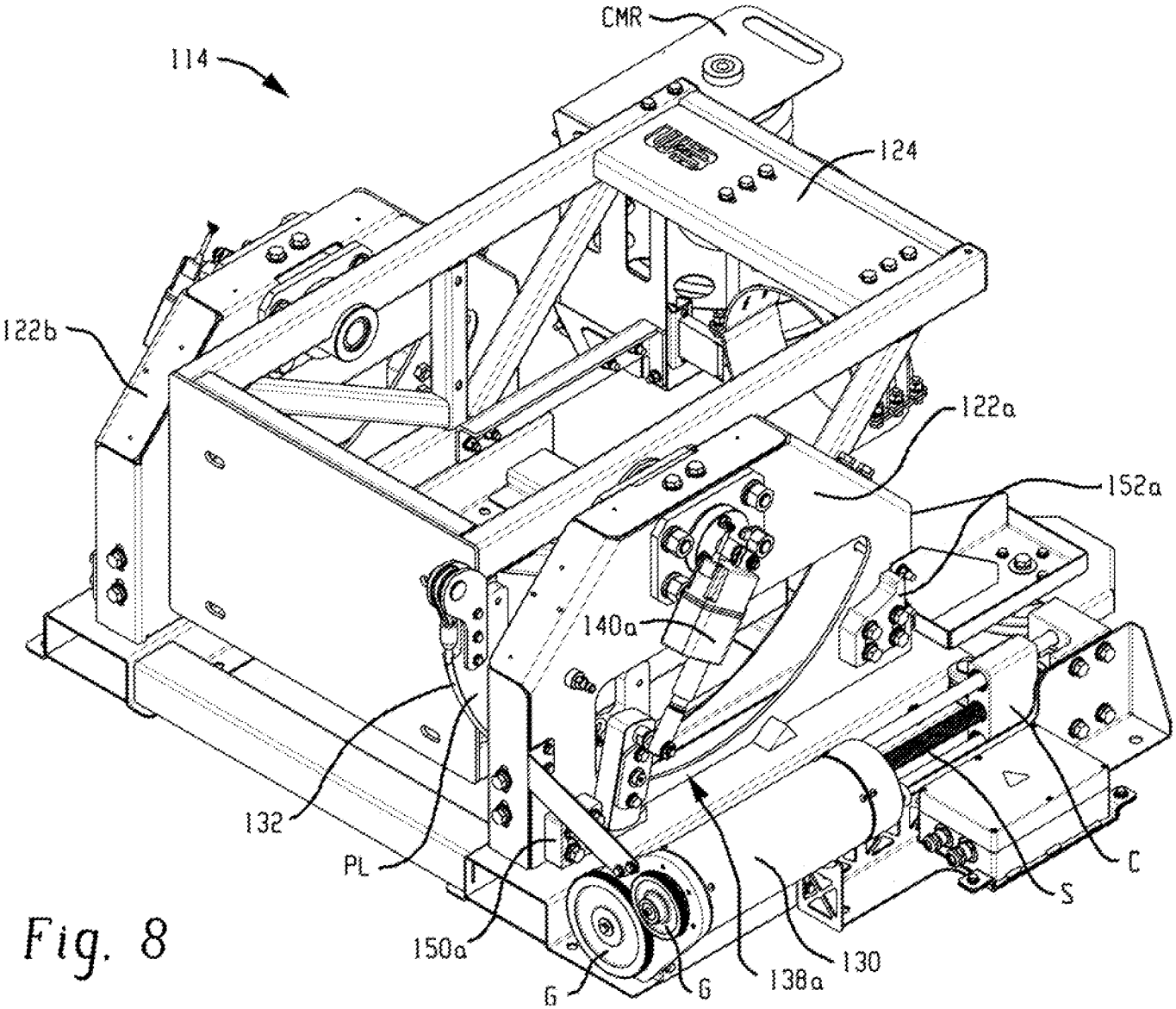
FIG. 8 is a rear left perspective view of the tilt assembly in a horizontal orientation.
Figure 9:
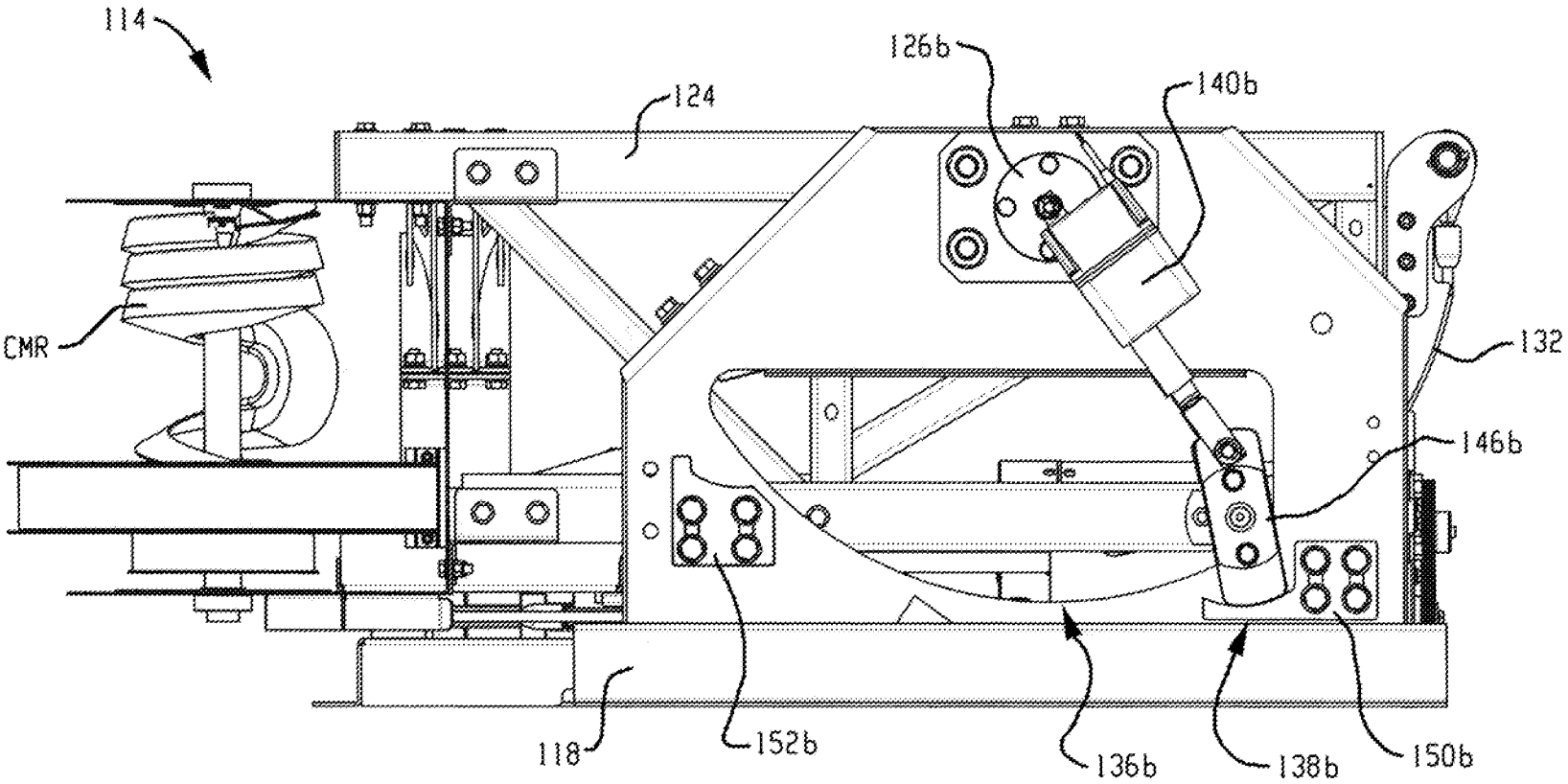
FIG. 9 is a right side elevation view of the tilt assembly in a horizontal orientation.
Figure 10:
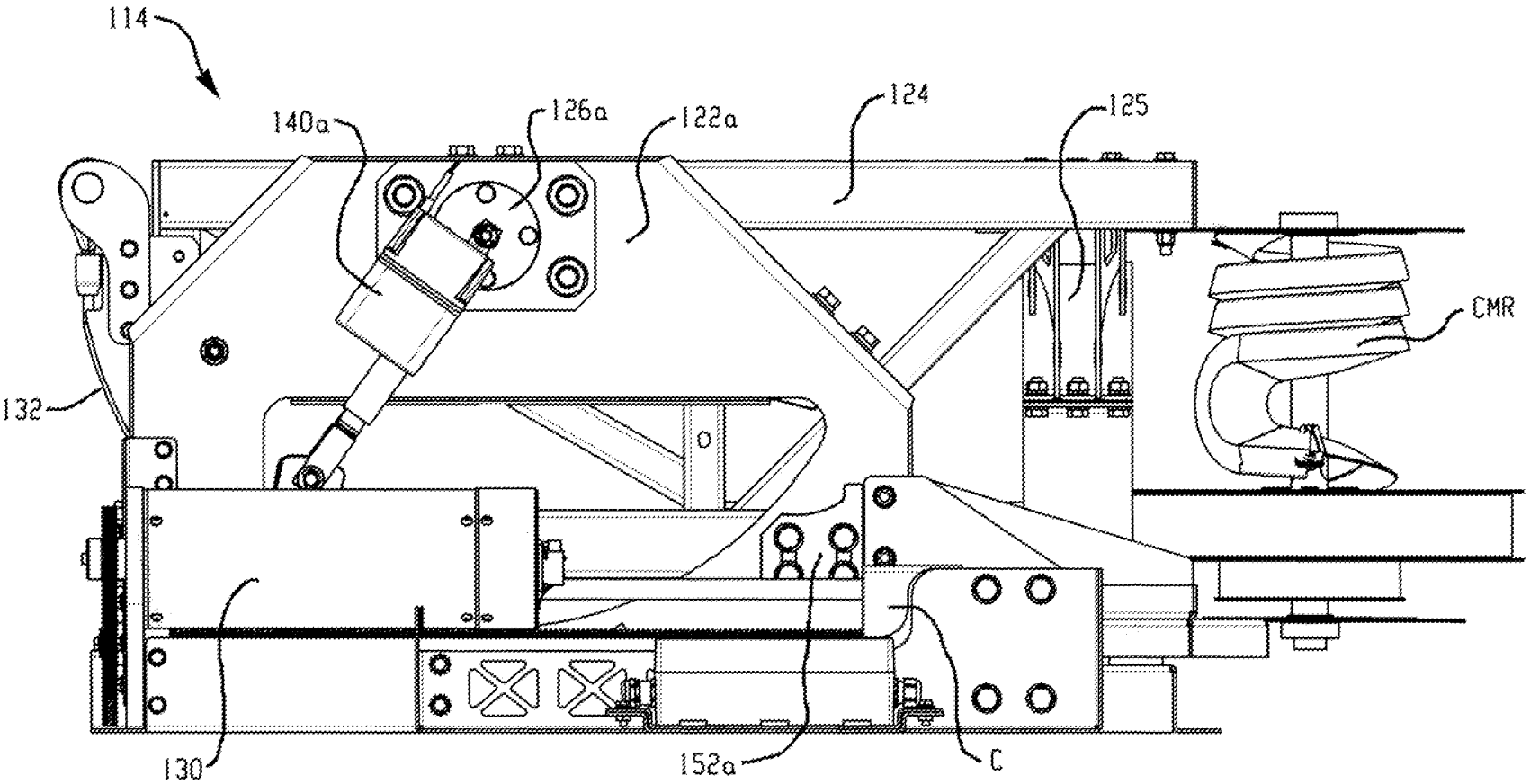
FIG. 10 is a left side elevation view of the tilt assembly in a horizontal orientation.
Figure 11:
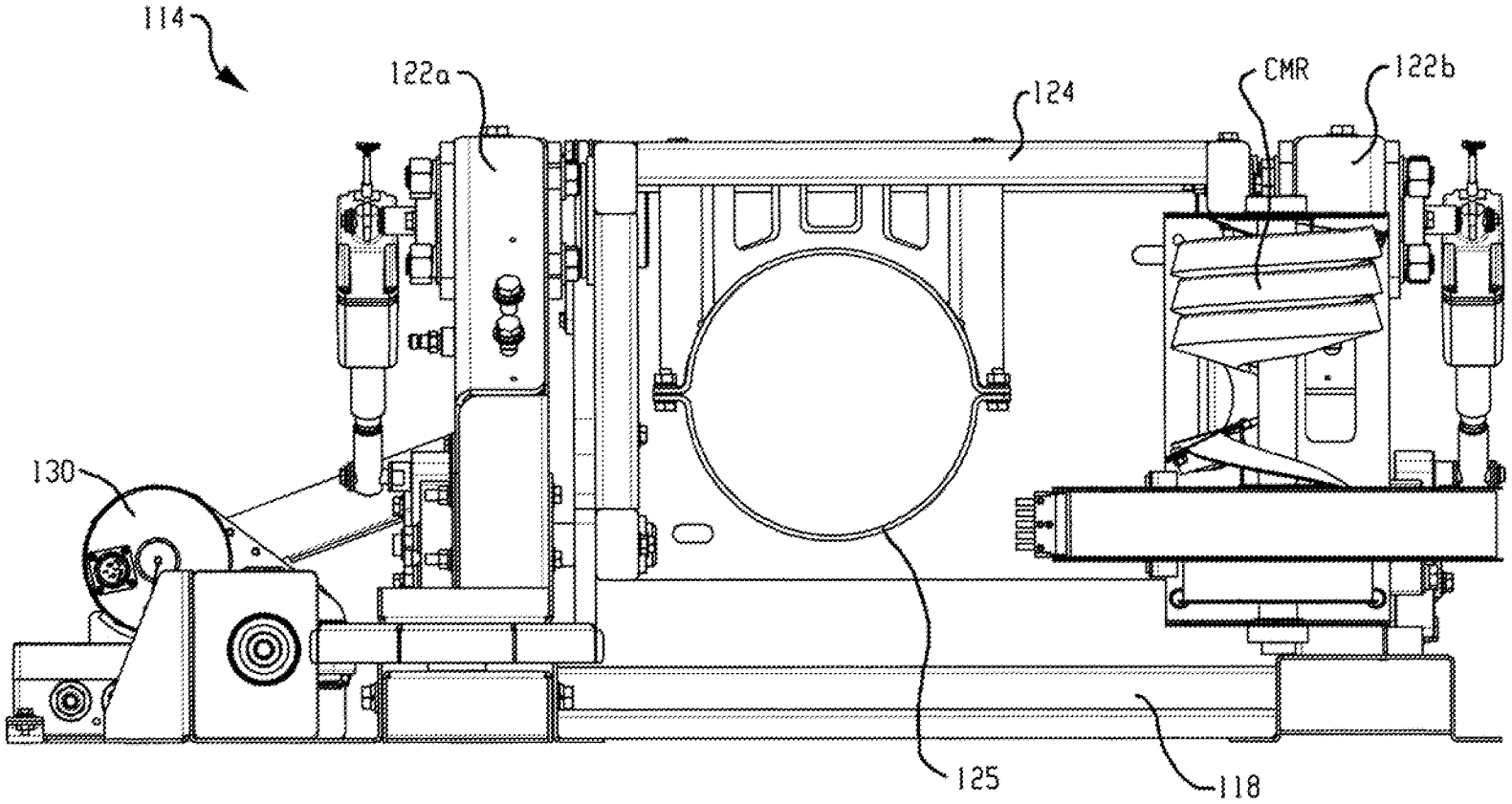
FIG. 11 is front elevation view of the tilt assembly in a horizontal orientation.
Figure 12:
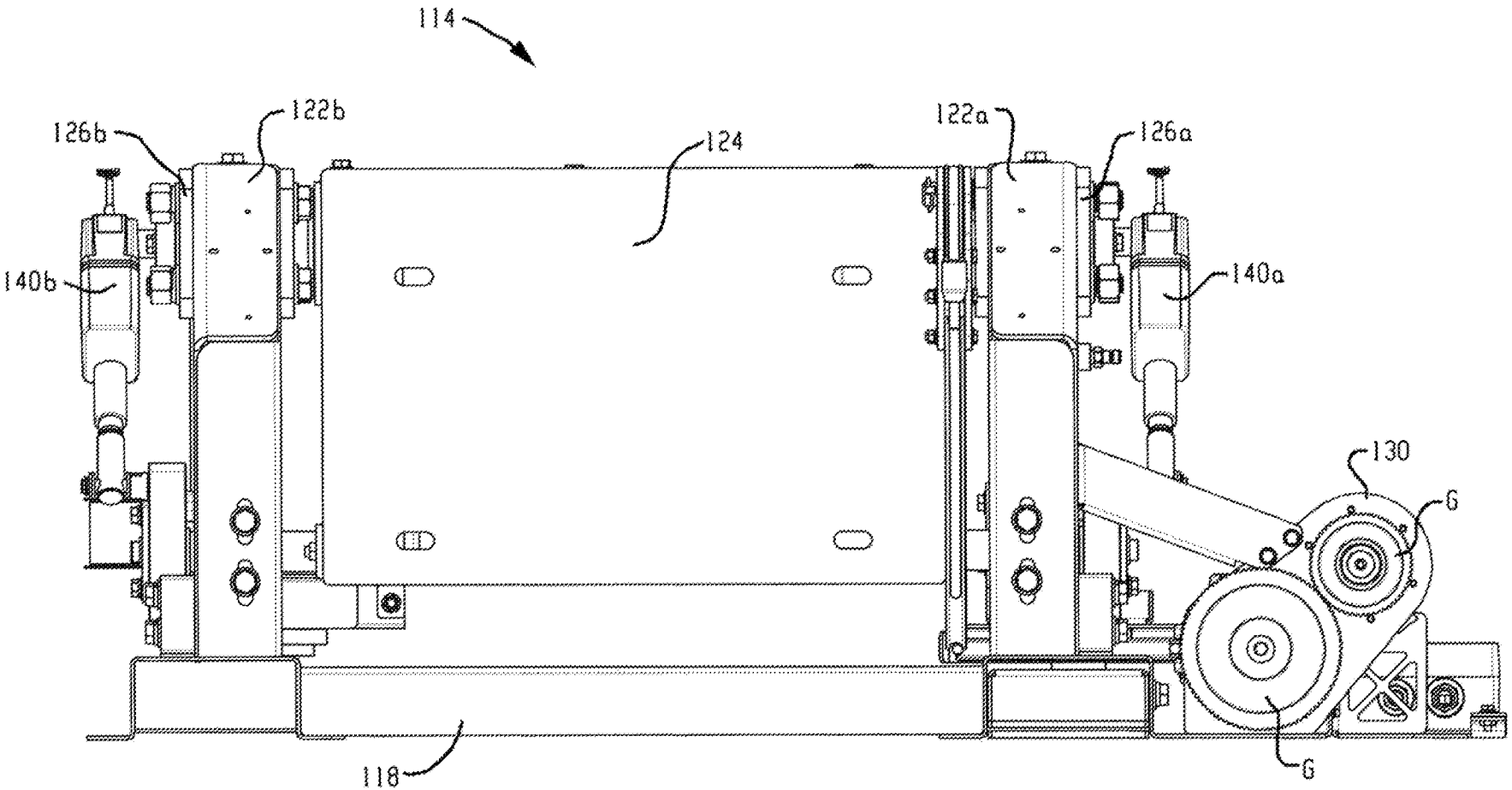
FIG. 12 is a rear elevation view of the tilt assembly in a horizontal orientation.
Figure 13:
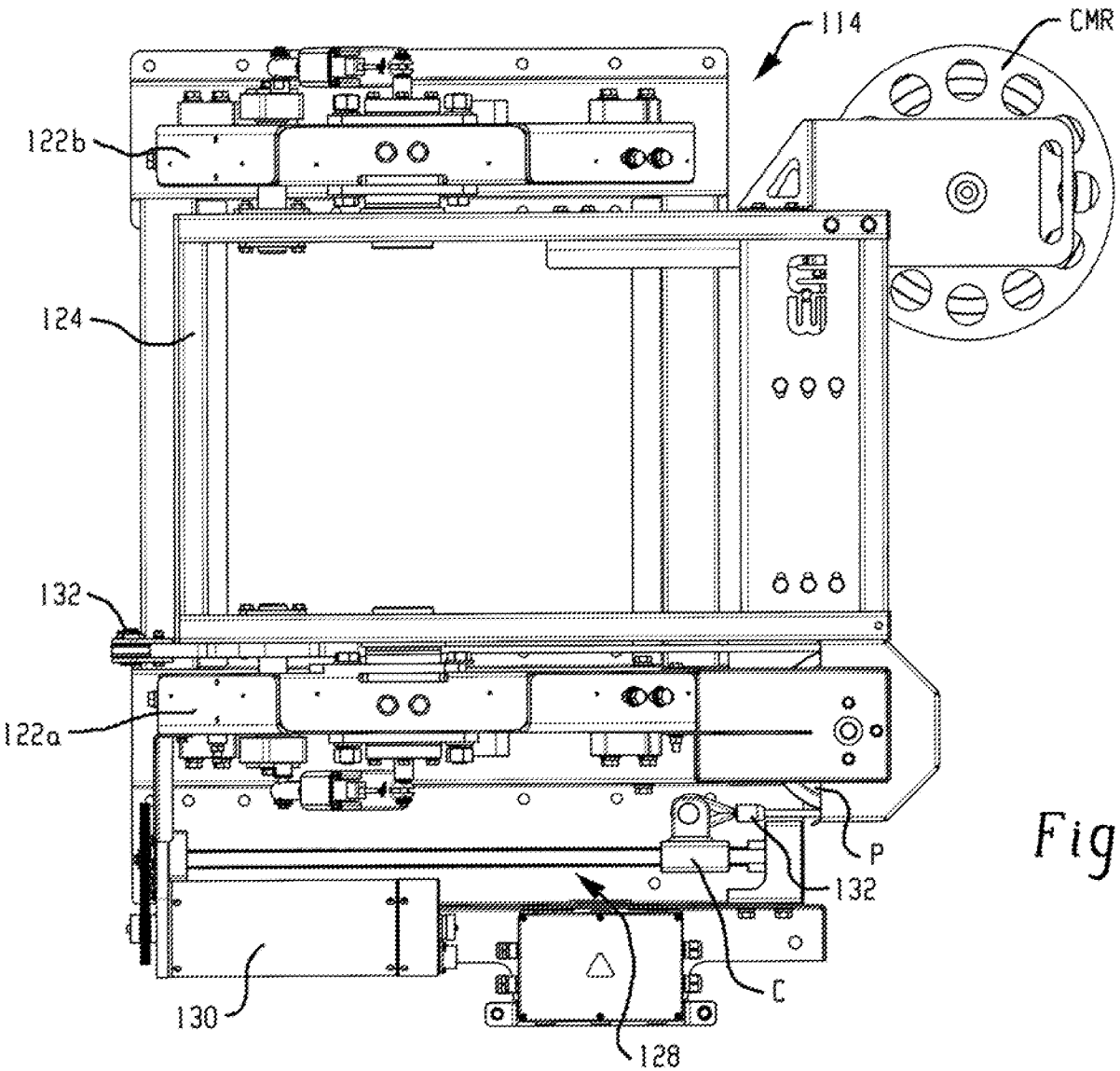
FIG. 13 is a plan view of the tilt assembly in a horizontal orientation.
Figure 14:
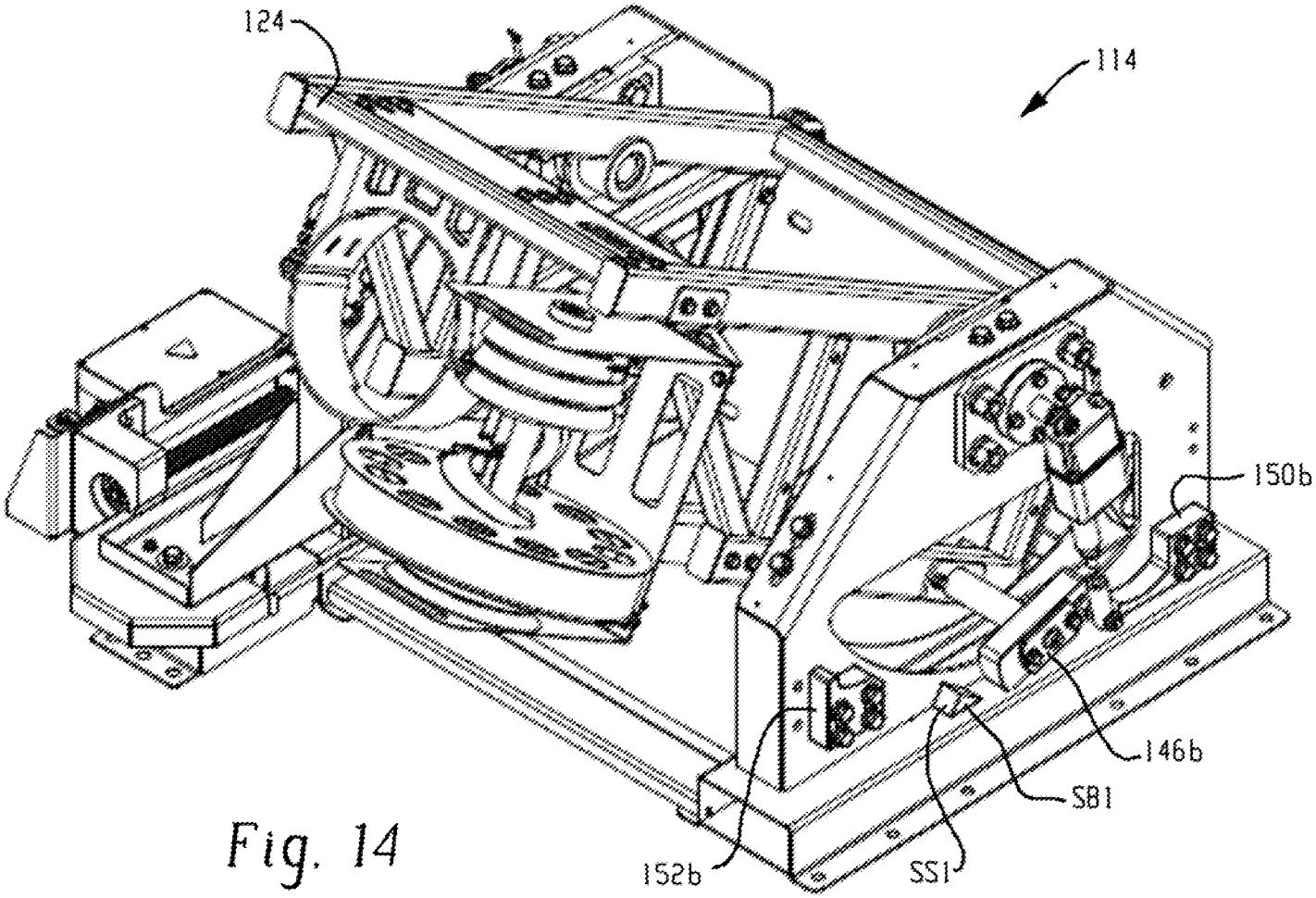
FIG. 14 is a front right perspective view of the tilt assembly in a partially tilted position.
Figure 15:
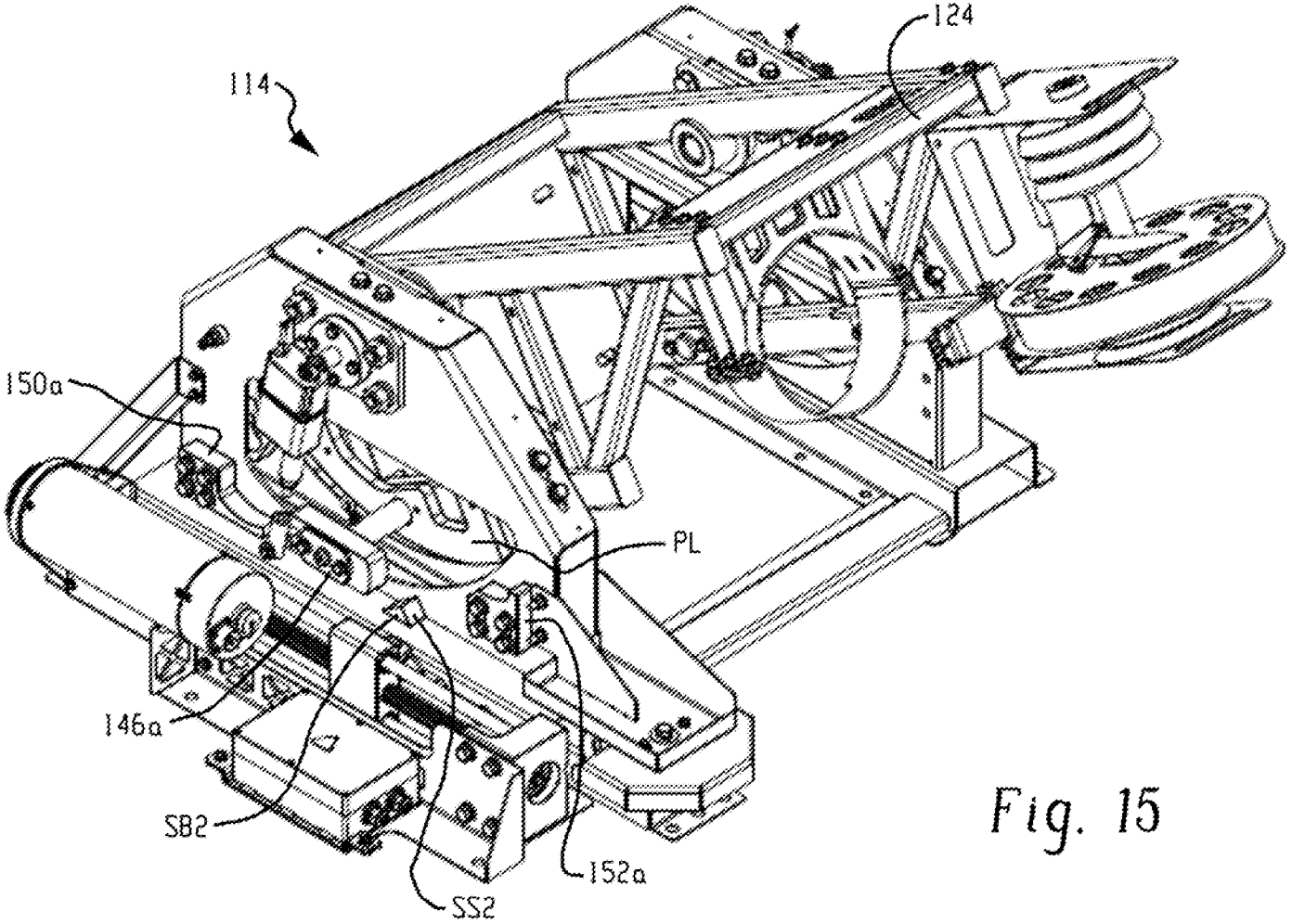
FIG. 15 is a front left perspective view of the tilt assembly in a partially tilted position.
Figure 16:
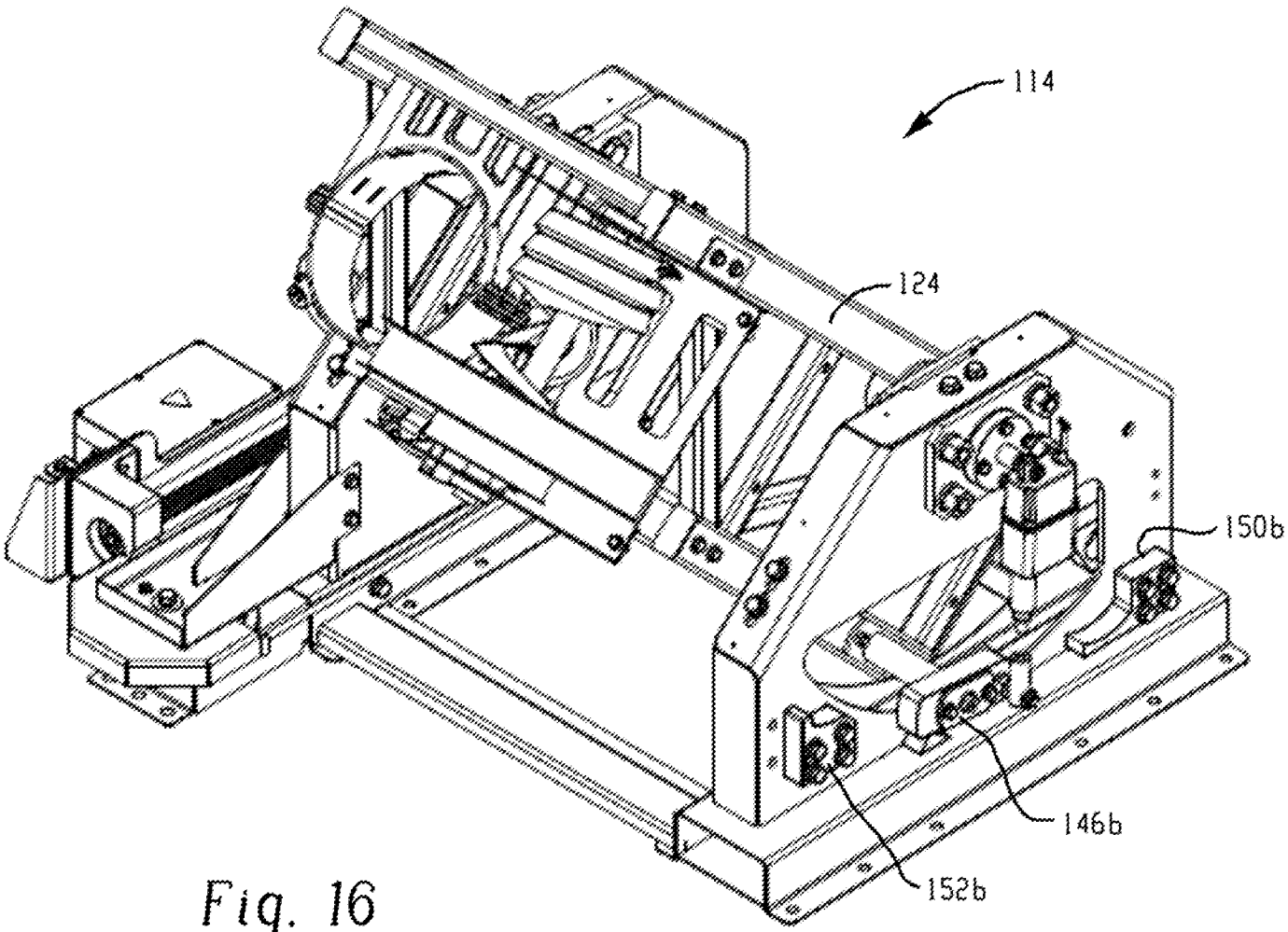
FIG. 16 is a front right perspective view of the tilt assembly in a partially tilted position.
Figure 17:
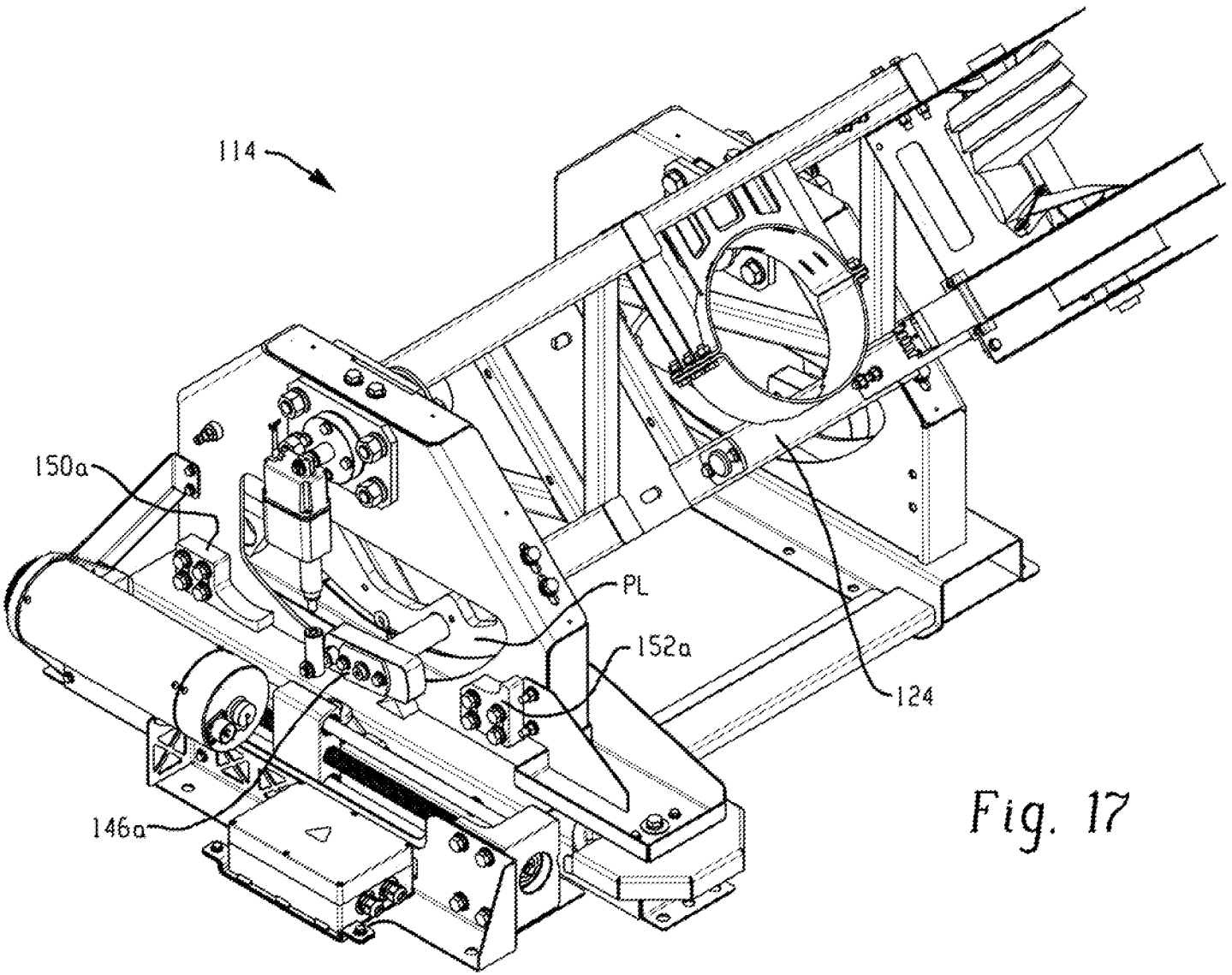
FIG. 17 is a front left perspective view of the tilt assembly in a partially tilted position.

The tilt assembly 114 includes an actuator that is configured to rotate the tilt frame 124 from the horizontal orientation to the vertical orientation. In this embodiment, the actuator includes a leadscrew 128 driven by an electric motor 130. The leadscrew 128 and electric motor 130 are mounted to the base 118 outboard of side wall 122*a*. As shown in FIG. 8, gears G couple the electric motor 130 to the screw S of the leadscrew 128. Gears G and/or the screw S can be manually turned in the event of a loss of power to the electric motor 130 such that the tilt frame can be rotated by hand if necessary. The electric motor 130 is reversible and, depending on the direction of rotation, is configured to rotate the screw S to advance or retract a carriage C along the longitudinal axis of the screw S, as conventional for such leadscrew devices. A best shown in FIG. 13, a cable 132 is secured to the carriage C such that the carriage C provides a pulling force on the cable 132. The cable 132 is routed around a pulley P and secured to a rear upper portion of the tilt frame 124. The tilt frame 124 includes a pulley plate PL (see FIGS. 8 and 15) mounted thereto having an arcuate cable groove CG in which the cable 132 is received.

It should now be appreciated that the leadscrew 128 can be actuated by the motor 130 to pull the cable 132 to thereby rotate the tilt frame 124 from the horizontal orientation to the vertical orientation as the carriage C is driven towards the gear end of the lead screw 128. As will be described in more detail below, the leadscrew 128 is also used to control the return of the tilt frame 124 to the horizontal orientation from the vertical orientation.

The tilt frame 124 includes outwardly extending rods 134*a*/134*b* that are received in openings 136*a*/136*b* in the side walls 122*a* and 122*b*. The range of motion of the tilt frame 124 is limited by the rods 132*a*/132*b* impinging on adjustable blocks at the ends of the openings 136*a*/136*b*. The tilt assembly 114 further includes a pair of locking mechanisms 138*a* and 138*b* for securing the tilt frame 124 in the horizontal and vertical orientations. Each locking mechanism includes an actuator 140*a*/140*b* (pneumatic, hydraulic, electric or otherwise) fixed for rotation with the tilt frame 124 about the tilt rotation axis A-A for rotation with the tilt frame 124. The other end of the actuator 140*a*/140*b* is fixed to a lock wedge 146*a*/146*b* that is supported for rotation on a rod 132*a*/132*b*. Each lock wedge 146*a*/146*b* is configured to engage with a horizontal lock wedge block 150*a*/150*b* (to lock the tilt frame 124 in the horizontal orientation) and a vertical lock wedge block 152*a*/152 (to lock the tilt frame 124 in the vertical orientation). Each of the lock wedge blocks 150*a*/150*b* and 152*a*/152*b* are adjustable in height to ensure a close fit with the lock wedges 146*a*/146*b*. This ensures that any play in the components can be taken up to ensure the system securely locks in the horizontal and vertical orientations.

Figure 7:
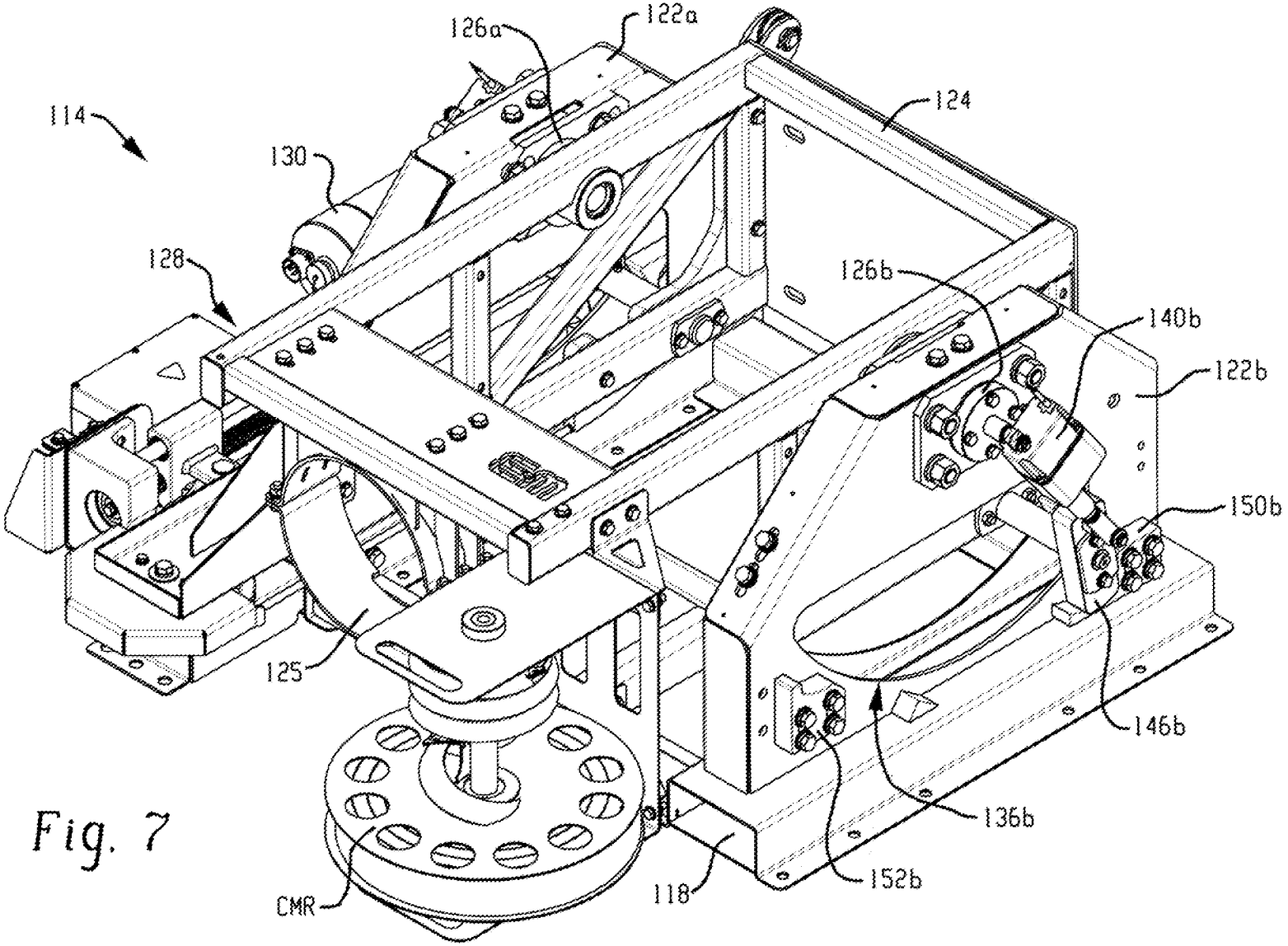
FIG. 7 is a front right perspective view of the tilt assembly in a horizontal orientation.

To deploy the mast assembly 110, actuators 140*a* and 140*b* are activated to disengage the lock wedges 146*a* and 146*b* from the horizontal lock wedge blocks 150*a* and 150*b* by rotating the lock wedges from the position shown in, for example, FIGS. 7 and 8. Meanwhile, the electric motor 130 is activated to drive the leadscrew 128 to pull the tilt frame 124 from the horizontal orientation to the vertical orientation, whereat the rods 128*a* and 128 meet a hard stop block at the end of the openings 136*a* and 136*b*. At this position, the actuators 140*a* and 140*b* are again activated to rotate the lock wedges 146*a* and 146*b* into engagement with the vertical lock wedge blocks 152*a* and 152*b*. The electric motor can then be deactivated, with the lock wedges 146*a* and 146*b* supporting the load of the mast and maintaining the tilt frame 124 in the vertical orientation against the vertical lock wedge blocks 152*a* and 152*b*. In some embodiments, the electric motor 130 can be reversed to remove the strain from the cable 132 and leadscrew 128 prior to deactivation.

To return the mast assembly 110 to the nested/stowed position (e.g., horizontal orientation), the electric motor 130 is activated to relieve the load from the locking mechanisms 138*a* and 138*b*. The locking actuators 140*a* and 140 are then activated to rotate the lock wedges 146*a* and 146*b* to a position to clear the vertical lock wedge blocks 152*a* and 152*b*. Because the tilt frame 124 is cantilevered from the rotation axis A-A in the vertical orientation, gravity tends to rotate the tilt frame 124 towards the horizontal orientation. As such, the electric motor 130 is activated to control the gravity-induced return of the tilt frame 124 to the horizontal orientation, at which time the locking actuators 140*a* and 140*b* can be activated to lock the tilt frame 124 in the horizontal orientation.

It should be appreciated that by locating the axis of rotation A-A of the tilt frame 124 at the upper portion of the tilt assembly 114 and supporting the mast 112 with the tilt frame 124 in a position offset from the axis of rotation A-A, the mast assembly 110 can be mounted immediately adjacent a vertical structure, such as a truck bed wall (e.g., adjacent the cab). As such, in the horizontal orientation, the mast 112 is coextensive with the base 118 thereby eliminating any dead space in the installation and maximizing the space for the mast assembly and/or payload within a given installation space. In some installations, the exemplary mast assembly 110 can be more closely positioned relative to a vehicle's center of mass thereby increasing or maintaining vehicle performance characteristics. Moreover, the exemplary mast assembly 110 can have a vertical height (in the horizontal orientation) of 21 inches or less such that it can be installed in a traditional truck bed without extending above the truck bed rails.

With reference to FIGS. 14-17, additional stop blocks SB1/SB2 (e.g., intermediate stop/lock blocks) having stop surfaces SS1 and SS2 are shown against which the lock wedges 146*a* and 146*b* of the locking mechanisms 140*a* and 140*b* can be configured to engage to limit the rotation of the tilt frame 124 during movement between vertical and vertical orientations. The stop surfaces SS1 and SS2 act along with the locking mechanisms 140*a* and 140*b* as detent mechanisms in the event of unexpected movement of the tilt frame 124 towards the horizontal orientation from the vertical orientation.

In operation, a control system configured for controlling the mast assembly 110 receives a signal or otherwise determines the absolute position of the tilt frame 124 travel between horizontal and vertical orientations. In one embodiment, a string potentiometer is used to determine the position of the carriage C on the screw S and this information is used to extrapolate an angular orientation of the tilt frame 124. Other position/orientation sensors can be used in place of or in addition to a string potentiometer. The control system uses the rotational position value of the tilt frame 124 to determine when to actuate and in what direction the linear actuators 140*a*/140*b* to engage/disengaged the lock wedges 146*a*/146*b* to allow the tilt frame 124 to pivot. In this regard, the controller may move the lock wedges 146*a*/146*b* to an angle that clears each block (e.g., SB1/SB2) as the lock wedges 146*a*/146*b* move past, and then actuates the linear actuators 142*a*/142 to rotate the lock wedges 146*a*/146*b* down after clearing each block to thereby position the lock wedges 146*a*/146*b* such that they will contact the stop surfaces SS1/SS2 should a drive system (e.g., hoist 130) failure occur thus preventing the mast and payload from returning to a horizontal orientation unexpectedly. In the illustrated embodiment, stop surface SS1 corresponds to approximately a 45-degree angle of the mast. In the vertical and horizontal orientation of the tilt frame 124, the controller C engages the lock wedges 146*a*/146*b* with respective wedge blocks to lock the tilt frame against rotation.

The lock wedges 146*a*/146*b* and the stops surfaces SS1 and SS2 of the present embodiment essential function as a noiseless and contactless (unless there is a failure) electronic ratchet mechanism. It should be appreciated that the stop surfaces SS1 and SS2 would typically be provided on both sides of the mast assembly 110. In addition to the above-noted operation, the control system could be configured to execute a command to gently travel the tilt frame 124 to one of the stop positions and engage the stop surface with the locking mechanisms 140*a* and 140*b* to lock the mast in a position for an installer to safely mount the payload or perform maintenance, for example.

In some embodiments, multiple intermediate stop blocks can be provided along the path of travel of the lock wedges 146*a*/146*b* such that the lock wedges 146*a*/146*b* can be configured to engage any adjacent stop block if needed to secure the tilt frame at an intermediate orientation for any reason.

Figure 18:
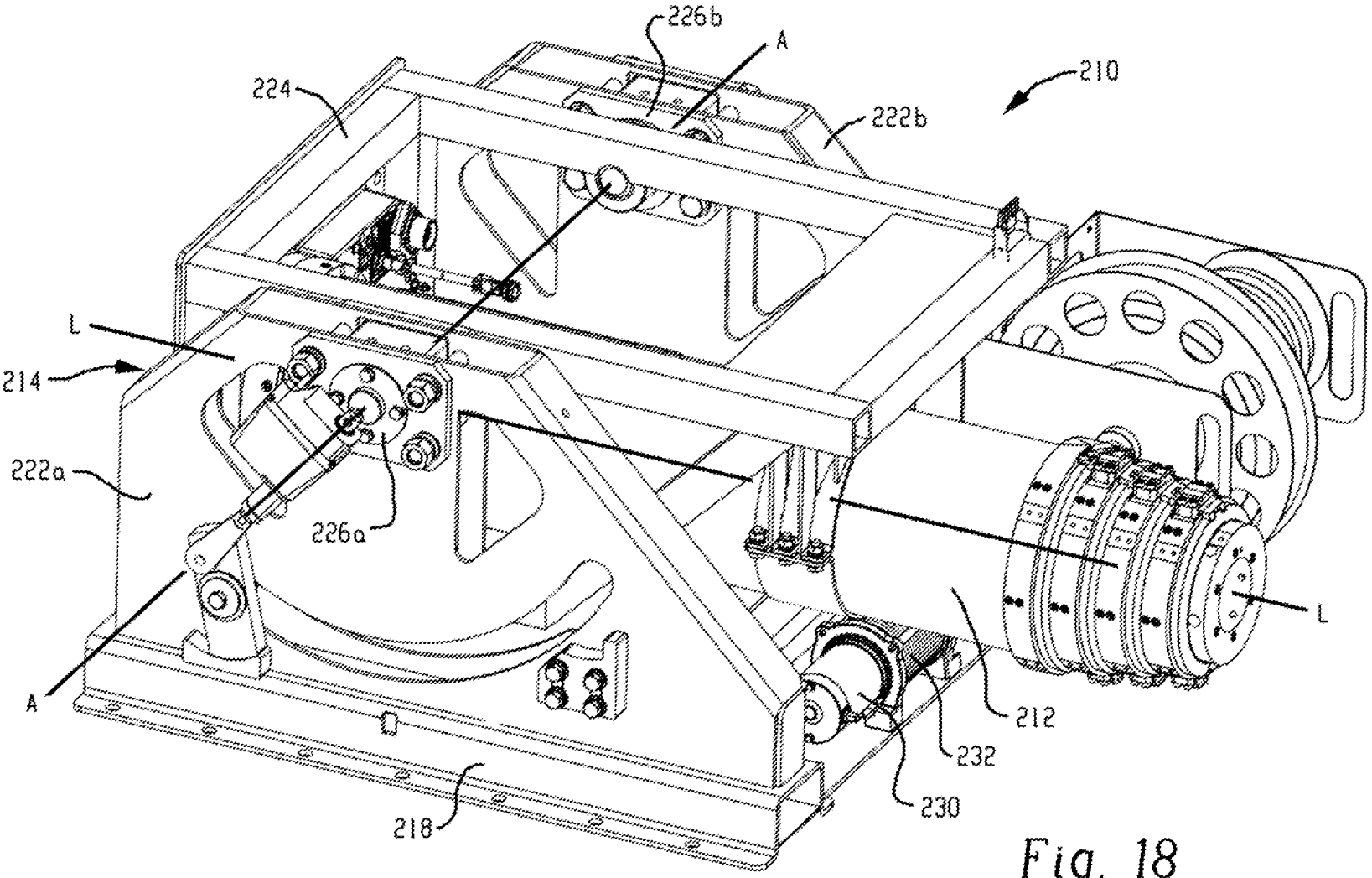
FIG. 18 a front left perspective view of another exemplary tilting and telescoping mast assembly in a horizontal orientation in accordance with the present disclosure.
Figure 19:
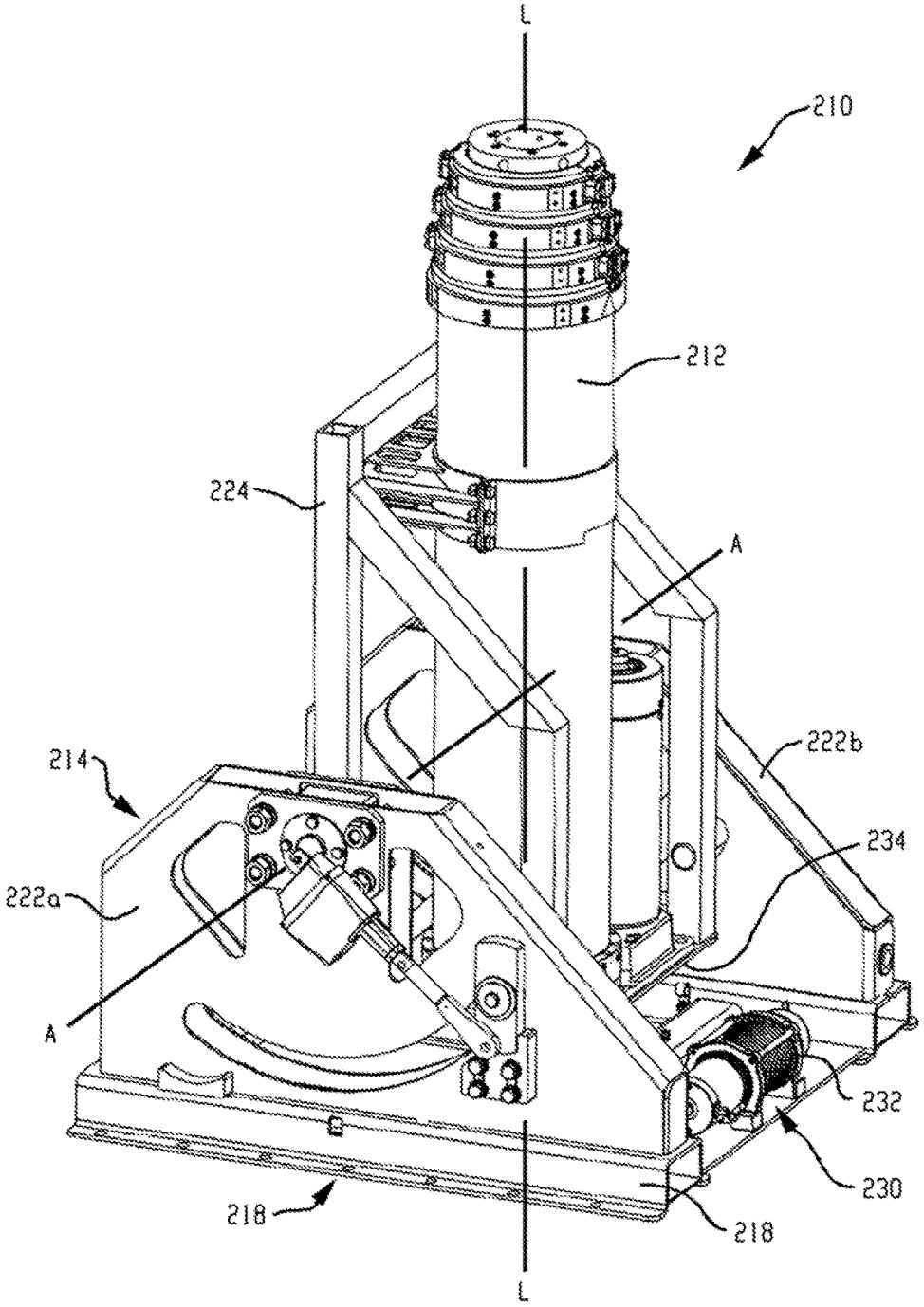
FIG. 19 is a front left perspective view of the mast assembly in a vertical orientation.

Turning to FIGS. 18 and 19, another exemplary embodiment of a tilt and telescoping mast assembly in accordance with the present disclosure is illustrated and identified generally by reference numeral 210. The mast assembly 210 includes a telescoping mast 212 having longitudinal axis L-L and being supported for movement between a horizontal orientation and a vertical orientation by a tilt assembly 214. The tilting and telescoping mast assembly 210 is illustrated in a horizontal orientation in FIG. 18, and a vertical orientation in FIG. 19.

The mast assembly 210 shares many of the same features as mast assembly 110 of FIGS. 2-17 and includes a base 218 mountable to a surface, such as a truck bed, and a pair of spaced-apart side walls 222*a* and 222*b* extending upwardly from the base 218. A tilt frame 224 is mounted to the side walls 222*a* and 222*b* by bearings 226*a* and 226*b*. The tilt frame 224 supports the mast 212 for pivoting movement about a tilt axis A-A between the horizontal orientation and the vertical orientation. The mast assembly 210 also includes locking mechanisms that function in a similar manner to locking mechanisms 140*a* and 140*b* and will not be described further here.

A main difference between the mast assembly 210 and the mast assembly 110, is that the tilt assembly 114 of this embodiment includes a hoist 230 that is configured to rotate the tilt frame 224 from the horizontal orientation to the vertical orientation. The hoist 230 can be an electric winch, for example. To this end, a cable 232 of the hoist 230 is secured to the tilt frame 224 at a rear lower portion 234 thereof. Attaching the cable 232 at this location maximizes the moment applied to the tilt frame 224 by the hoist 230 when the tilt frame 224 begins rotation from the horizontal orientation towards the vertical orientation. As will be described in more detail below, the hoist 230 is also used to control the return of the tilt frame 224 to the horizontal orientation from the vertical orientation.

To deploy the mast assembly 210, the locking mechanisms are actuated in similar manner to the locking mechanisms 140*a*/140*b* to release the tilt frame 224 for pivoting motion. Meanwhile, the hoist 230 is activated to pull the tilt frame 224 from the position of FIG. 18 to the position of FIG. 19. At this position, the locking members are actuated to lock the tilt frame 224 in the vertical orientation in a manner similar to locking mechanisms 140*a*/140*b*. The hoist 230 can then be deactivated, with the locking mechanisms supporting the load of the mast and maintaining the tilt frame 224 in the vertical orientation.

To return the mast assembly 210 to the nested/stowed position (e.g., horizontal orientation), the hoist 230 is activated to relieve the load from the locking mechanisms, and then the locking mechanisms are actuated to release the tilt frame 224 for pivoting motion. Because the tilt frame 224 is cantilevered from the rotation axis A-A in the vertical orientation, gravity tends to rotate the tilt frame 224 towards the horizontal orientation. As such, the hoist 230 is activated to control the gravity-induced return of the tilt frame 224 to the horizontal orientation, at which time the locking mechanisms can be activated to lock the tilt frame 224 in the horizontal orientation.

Turning now to FIGS. 20-25, another exemplary tilting and telescoping mast assembly is illustrated and identified generally by reference numeral 310. The mast assembly 310 includes a telescoping mast 312 supported for movement between a horizontal orientation and a vertical orientation by an articulating tilt assembly 314. The telescoping mast 312 can be any suitable telescoping mast and, as such, further details of the telescoping mast 312 will not be described.

The articulating tilt assembly 314 includes a base 318 mountable to a surface, such as a truck bed, and a pair of spaced-apart side supports 322*a* and 322*b* extending upwardly from the base 318. The base 318 and side supports 322*a* and 322*b* support a pair of spaced-apart curved tracks 324*a* and 324*b*. A carriage 330 having a plurality of wheels 332 is supported for movement along the arcuate (approximately 90-degree arc) tracks 324*a* and 324*b*. The telescoping mast 312 is supported by the carriage 330 for movement between the horizontal and vertical orientations.

Figure 20:
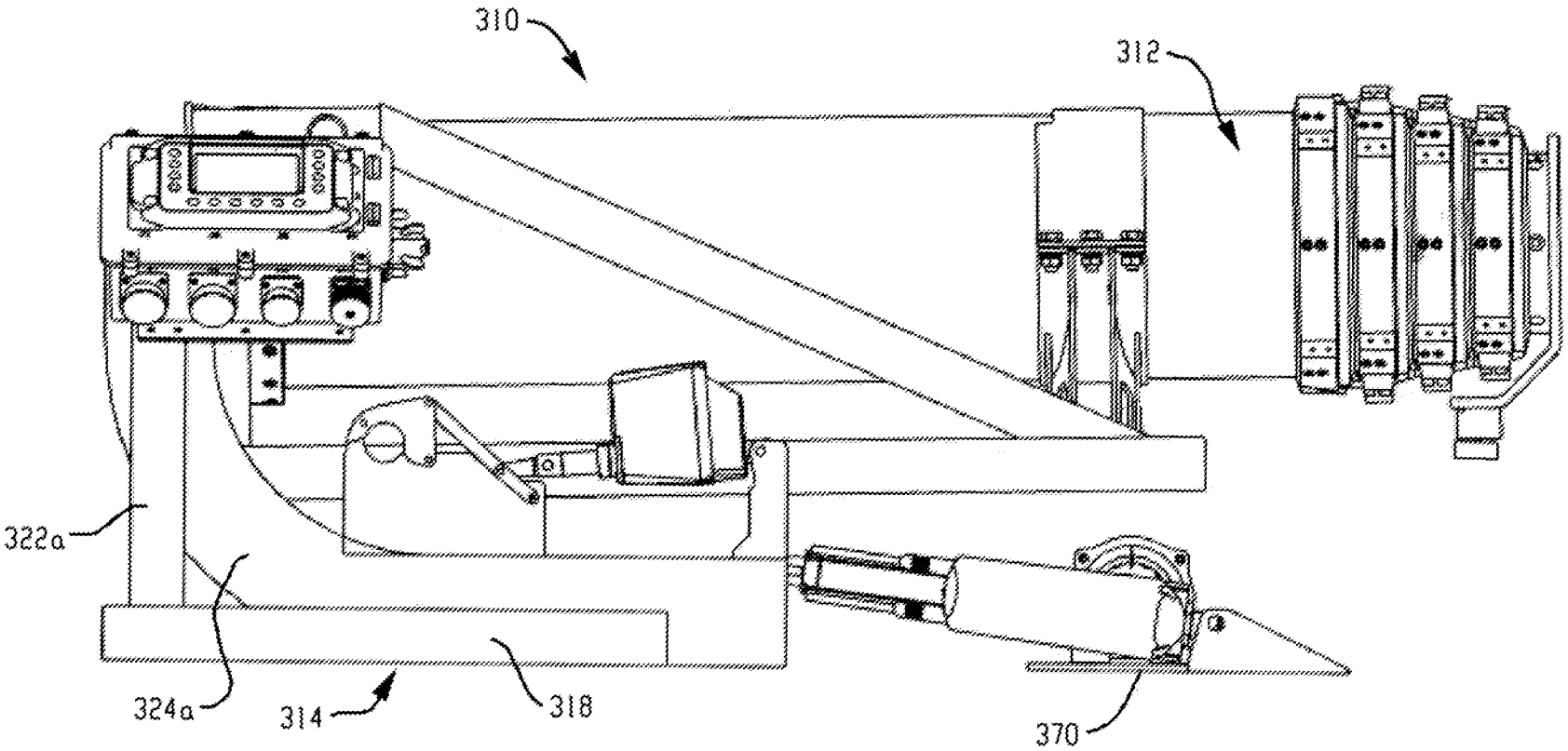
FIG. 20 is a left side elevation view of another exemplary tilting and telescoping mast assembly in a horizontal orientation in accordance with the present disclosure.
Figure 21:
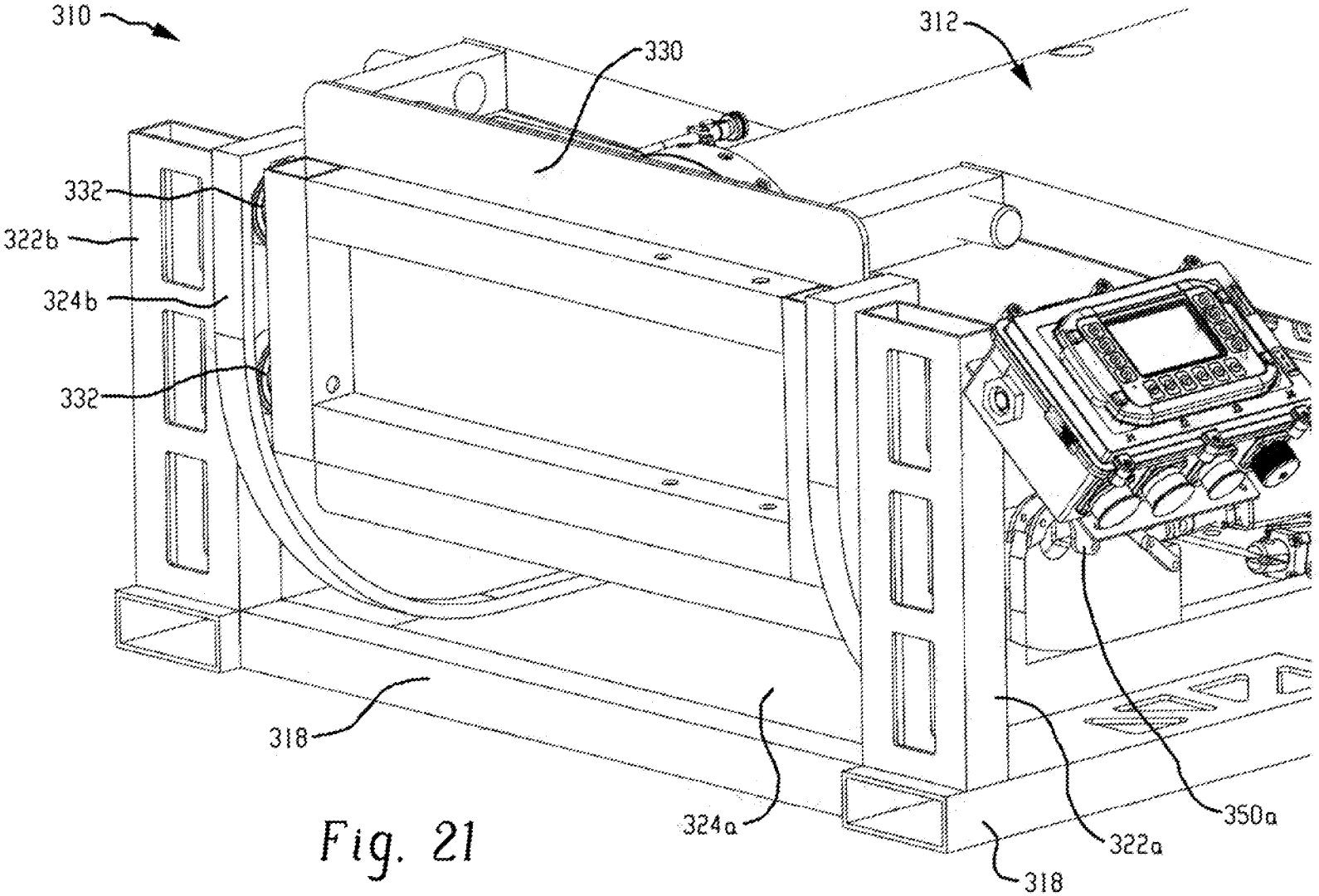
FIG. 21 is a rear left perspective of the mast assembly in a horizontal orientation.
Figure 22:
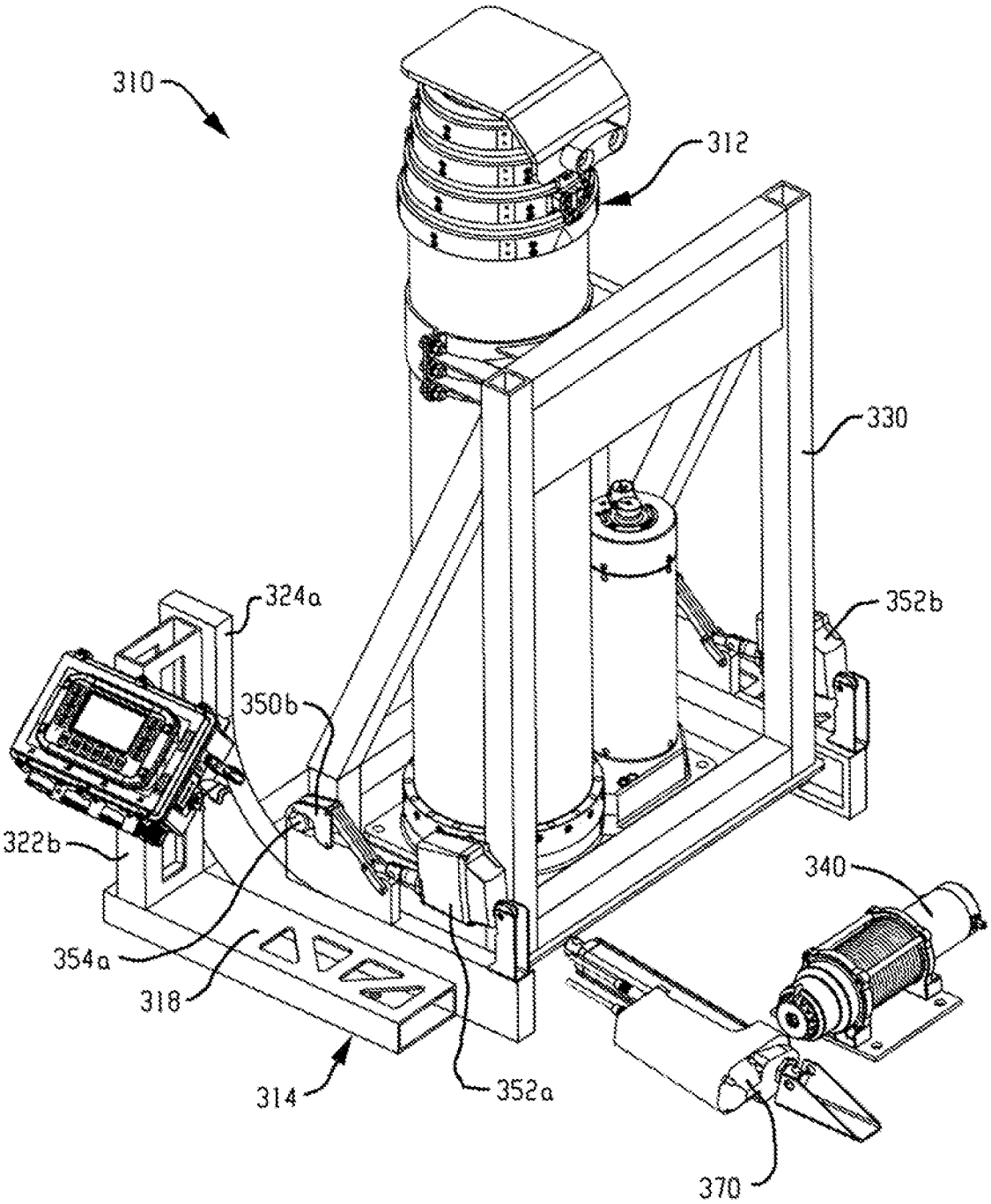
FIG. 22 is front left perspective of the mast assembly in a vertical orientation.
Figure 23:
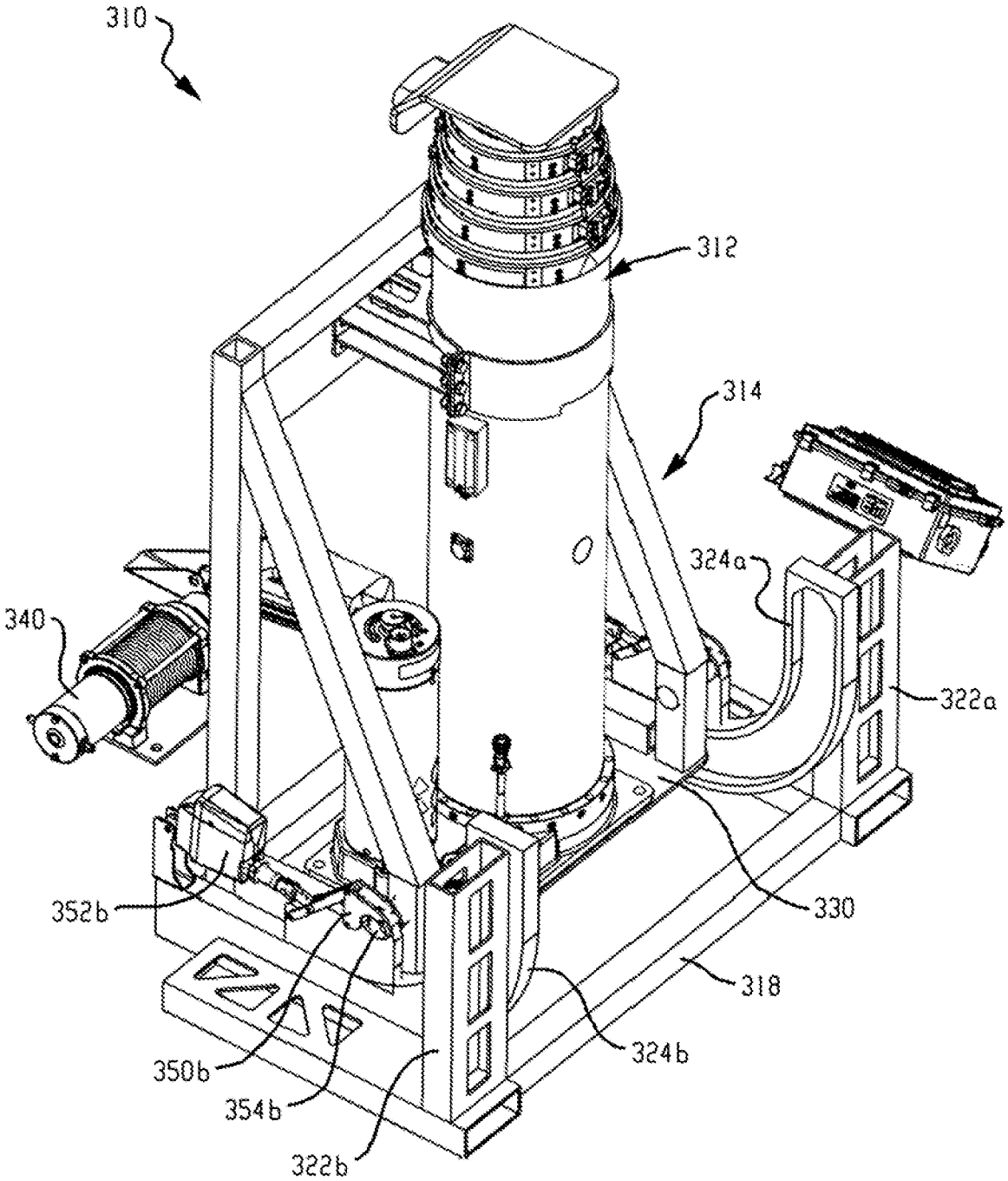
FIG. 23 is a rear right perspective of the mast assembly in a vertical orientation.
Figure 24:
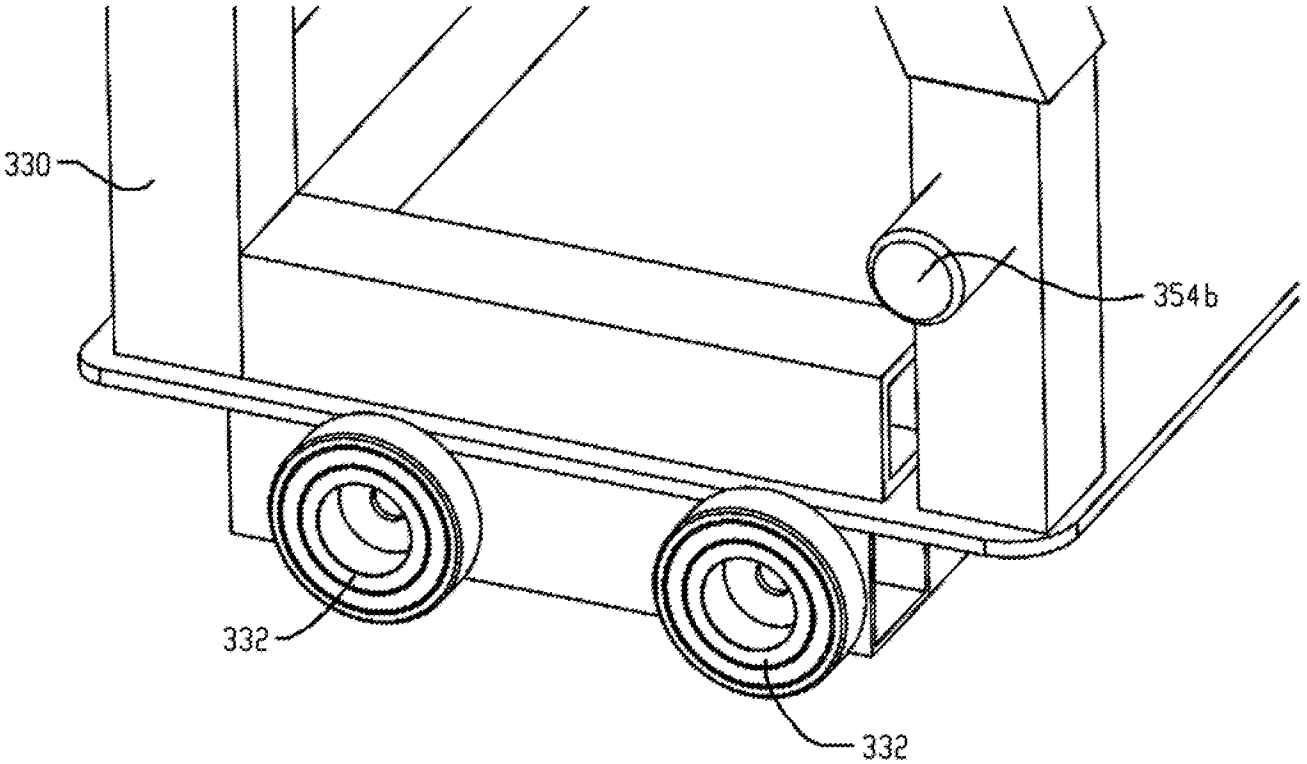
FIG. 24 is a perspective view of an exemplary tilt carriage in accordance with the present disclosure.
Figure 25:
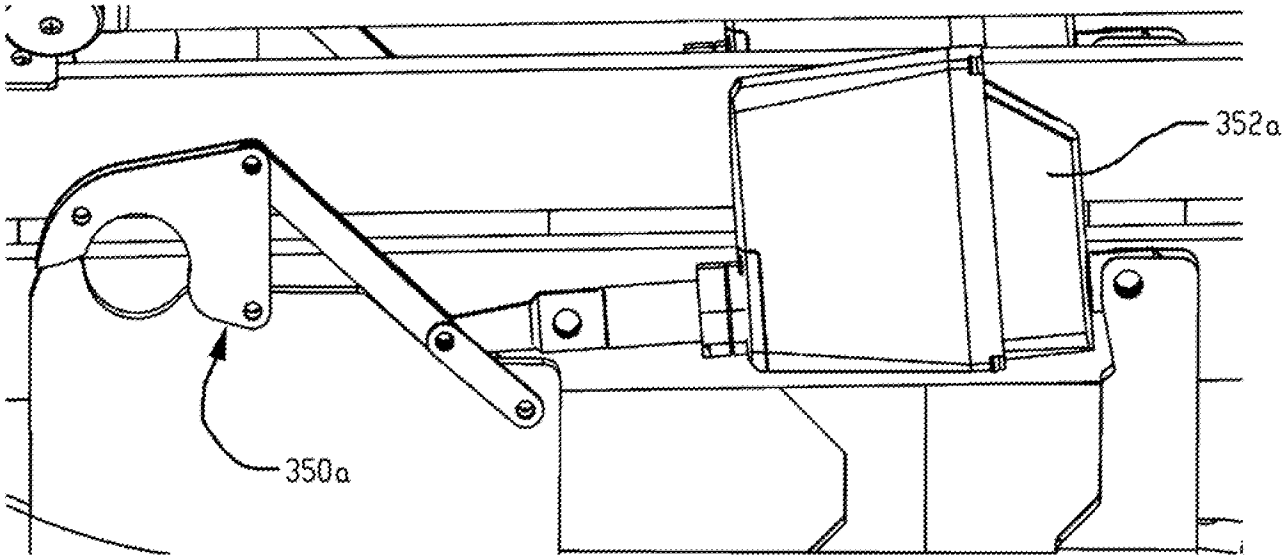
FIG. 25 is a side elevation view of an exemplary locking mechanism in accordance with the present disclosure.

The articulating tilt assembly 314 includes a hoist 340 configured to pull the carriage 330 from the position shown in FIGS. 20 and 21 to the position shown in FIGS. 22 and 23. As shown in FIG. 21, the leading wheels 332 rest on the curved section of the tracks 324*a* and 324*b* such that force applied by the hoist 340 has a downward vector to initiate the downward motion of the carriage 330.

Once the carriage 330 is in the position of FIGS. 22 and 23, the leading wheels 332 are pulled against a ramp surface at a terminal end of the tracks 324*a* and 324*b* to create a fixed point to resist wind load on the mast assembly 312. A pair of over-toggle clamps 350*a* and 350*b* on each track 324*a* and 324*b* are triggered by a respective linear actuator 352*a* and 352*b* to clamp pins 354*a* and 354*b* of the carriage 330. The hoist 340 can then be relaxed with the carriage 330 remaining in the upright position.

To return the mast assembly 310 to the nested/stowed position (e.g., horizontal orientation), the over-toggle clamps 350*a* and 350*b* are released and a linear actuator 370 (pneumatic, hydraulic, electric or otherwise) pushes the carriage 330 back up the tracks 324*a* and 324*b* until gravity acting on the mast assembly 312 is sufficient to drive the carriage 330 back to the position of FIG. 20. The hoist 340 is activated to control the movement of the carriage 330 once gravity takes over.

In some embodiments, the tracks 324*a*/324*b* can include a bumper or spring-loaded stop (not shown) at each end against which the wheels 332 engage at the limits of their travel on the tracks 324*a*/324*b* to dampen the motion of the carriage 330 and also provides some force assist for the hoist 340 for the initial inch of travel when the hoist 340 force vectors are at their worst case (e.g., has to pull the hardest to move the carriage 330).

It should be appreciated that the control of the various components of the exemplary embodiments including the hoist, linear actuators, telescoping mast, etc. can be performed by a controller C. The controller C can include a control interface such as a CAN-bus programmable display.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A tilting and telescoping mast assembly comprising:

a mast having a longitudinal axis;

a tilt mechanism supporting the mast assembly configured for p about a tilt rotation axis between a first position and a second position;

wherein the tilt rotation axis is perpendicular to and spaced from the longitudinal axis of the mast;

whereby the mast is displaced in a horizontal direction as the tilt mechanism rotates the mast assembly between the first and second positions;

wherein the tilt mechanism includes a base mountable to a surface, first and second side walls extending from the base, and a tilt frame supported between the first and second side walls for movement between a horizontal orientation and a vertical orientation, and wherein the mast is supported by the tilt frame; and the tilting and telescoping mast assembly further comprises a locking mechanism configured to secure the tilt frame in at least one of the first position or the second position, wherein the locking mechanism includes a lock wedge supported on a rod of the tilt frame and configured to engage an adjustable height lock block supported on an outside of one of the side walls to restrict movement of the tilt frame relative to the side wall, the lock wedge being rotatable between a release position and an engaged position.

2. The tilting and telescoping mast assembly of claim 1, wherein at least one of the side walls includes an opening through which the rod extends, the rod configured to move within the opening as the tilt frame pivots between the first and second positions.

3. The tilting and telescoping mast assembly of claim 2, further comprising an actuator operatively coupled to the lock wedge to rotate the lock wedge between the release position and the engaged position.

4. The tilting and telescoping mast assembly of claim 3, further comprising a tilt actuator operatively coupled to the tilt frame rotate the tilt frame.

5. The tilting and telescoping mast assembly of claim 4, wherein the tilt actuator includes a leadscrew coupled to the tilt frame, the leadscrew operative to rotate the tilt frame from the horizontal orientation to the vertical orientation when turned in a first direction.

6. The tilting and telescoping mast assembly of claim 5, wherein the leadscrew includes a threaded shaft and a carriage threadedly engaged with the threaded shaft such that rotation of the leadscrew in a first direction advances the carriage along the shaft and rotation of the leadscrew in a second direction opposite the first direction retracts the carriage along the shaft, and wherein the carriage is coupled to the tilt frame by a cable.

7. The tilting and telescoping mast assembly of claim 6, further comprising a horizontal lock block, a vertical lock block and an intermediate lock block, wherein each of the lock blocks are mounted to a common sidewall adjacent the opening in the sidewall, and wherein the lock wedge is separately engageable with any one of the lock blocks when the lock block is in a first orientation to secure the tilt frame against rotation, and wherein the lock wedge, in a second orientation, passes freely by the intermediate lock block as the tilt frame moves between the horizontal and vertical orientations, whereby the lock wedge and the intermediate lock block function as a silent ratchet mechanism.

8. A tilt mechanism for supporting an associated mast for pivoting between a first position and a second position about a tilt rotation axis, the tilt mechanism comprising a tilt frame supported for rotation about the tilt rotation axis, wherein the tilt rotation axis is perpendicular to and spaced from a longitudinal axis of the associated mast;

whereby the associated mast is displaced in a horizontal direction and drives the tilt motion as the tilt mechanism rotates the associated mast between the first and second positions, wherein the tilt mechanism includes a base mountable to a surface, first and second side walls extending from the base, and a tilt frame supported between the first and second side walls for movement between a horizontal orientation and a vertical orientation, and wherein the mast is supported by the tilt frame; and the tilt mechanism further comprises a locking mechanism configured to secure the tilt frame in at least one of the first position or the second position, wherein the locking mechanism includes a lock wedge supported on a rod of the tilt frame and configured to engage an adjustable height lock block supported on an outside of one of the side walls to restrict movement of the tilt frame relative to the side wall, the lock wedge being rotatable between a release position and an engaged position.

9. The tilt mechanism of claim 8, further comprising bearings received in each side wall for supporting the tilt frame for pivoting.

10. A tilt mechanism for supporting an associated mast for pivoting between a first position and a second position about a tilt rotation axis, the tilt mechanism comprising a tilt frame supported for rotation about the tilt rotation axis, wherein the tilt rotation axis is perpendicular to and spaced from a longitudinal axis of the associated mast;

whereby the associated mast is displaced in a horizontal direction as the tilt mechanism rotates the associated mast between the first and second positions;

the tilt mechanism further comprising:

a base mountable to a surface, and first and second side walls extending from the base, wherein the tilt frame is supported between the first and second side walls for movement between a horizontal orientation and a vertical orientation, and wherein the associated mast is supported by the tilt frame; and a locking mechanism configured for securing the tilt frame in at least one of the first position or the second position, wherein the locking mechanism includes a lock wedge supported on a rod of the tilt frame and configured to engage a lock block supported on an outside of one of the side walls to restrict movement of the tilt frame relative to the side wall, the lock wedge being rotatable between a release position and an engaged position.

11. The tilt mechanism of claim 10, wherein at least one of the side walls includes an opening through which the rod extends, the rod configured to move within the opening as the tilt frame pivots between the first and second positions.

12. The tilt mechanism of claim 11, further comprising an actuator operatively coupled to the lock wedge to rotate the lock wedge between the release position and the engaged position.

13. The tilt mechanism of claim 12, further comprising a tilt actuator operatively coupled to the tilt frame rotate the tilt frame, wherein the tilt actuator includes a leadscrew coupled to the tilt frame, the leadscrew operative to rotate the tilt frame from the horizontal orientation to the vertical orientation when turned in a first direction, and wherein the leadscrew includes a threaded shaft and a carriage threadedly engaged with the threaded shaft such that rotation of the leadscrew in a first direction advances the carriage along the shaft and rotation of the leadscrew in a second direction opposite the first direction retracts the carriage along the shaft, and wherein the carriage is coupled to the tilt frame by a cable.

* * * * *